US006253049B1

(12) United States Patent
Baek et al.

(10) Patent No.: US 6,253,049 B1
(45) Date of Patent: Jun. 26, 2001

(54) LIQUID DEVELOPER REFILLING SYSTEM OF LIQUID ELECTROPHOTOGRAPHIC PRINTER AND METHOD THEREOF

(75) Inventors: Chung-guk Baek; Geun-yong Park; Seung-ho Hong, all of Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/525,167

(22) Filed: Mar. 14, 2000

(30) Foreign Application Priority Data

Mar. 15, 1999 (KR) ..... 99-8583

(51) Int. Cl.[7] ..... G03G 15/10
(52) U.S. Cl. ..... 399/238; 399/12
(58) Field of Search ..... 399/238, 237, 399/119, 120, 12, 224, 233; 222/DIG. 1; 347/85, 86, 214

(56) References Cited

U.S. PATENT DOCUMENTS 6,032,010 * 2/2000 Kim et al. ..... 399/238
6,101,356 * 8/2000 Kim et al. ..... 399/237 X

FOREIGN PATENT DOCUMENTS 5-165299 * 7/1993 (JP) .

* cited by examiner

*Primary Examiner*—Sophia S. Chen
(74) *Attorney, Agent, or Firm*—Sughrue, Mion, Zinn, Macpeak & Seas, PLLC

(57) ABSTRACT

A liquid developer refilling system of a liquid electrophotographic printer for supplying any one of concentrated inks and a carrier to corresponding one of ink storage tanks and a carrier storage tank installed in the printer, and a method thereof. The system includes: a main frame provided with a common installation portion; an auxiliary frame installed to be movable with respect to the main frame; a cartridge installed at the installation portion and provided with a discharge hole through which a concentrated ink or carrier is discharged by compressed air; a fastener for fixing the cartridge installed at the installation portion to the main frame; a valve unit provided with a plurality of valves which can be selectively matched with the discharge hole and installed to be movable with respect to the auxiliary frame; and a valve raising/lowering mechanism which raises or lowers the auxiliary frame with respect to the main frame to connect or disconnect a corresponding valve to or from the discharge hole.

34 Claims, 18 Drawing Sheets

LIQUID DEVELOPER REFILLING SYSTEM OF LIQUID ELECTROPHOTOGRAPHIC PRINTER AND METHOD THEREOF

BACKGROUND OF THE INVENTION

1. Field of the Invention

The present invention relates to a liquid developer refilling system of a liquid electrophotographic printer and a method thereof, and more particularly, to a liquid developer refilling system of a liquid electrophotographic printer, in which in order to supply any one of concentrated inks and a liquid carrier stored in a cartridge to a corresponding one of a plurality of ink tanks and a carrier tank equipped within the main body of the printer, the structure thereof is improved so that a corresponding valve of a plurality of valves can be automatically connected to the cartridge by matching the corresponding valve to the cartridge after identifying the cartridge installed at a common installation portion which is provided at a main body of a printer, and a method thereof.

2. Description of the Related Art

In general, in a printing device such as a laser printer or a copier, a latent electrostatic image formed on the surface of a photosensitive medium such as a photosensitive belt is developed with a liquid developer composed of a solid toner having a predetermined color and a liquid carrier functioning as a solvent; and the developed image is transferred to a paper.

A conventional liquid electrophotographic printing device includes an ink supplying structure in which ink cartridges and a carrier cartridge are installed at a main body of the printing device. Concentrated inks and a carrier within the cartridges are supplied to a developing unit, and liquid developers required for the printing device are made by mixing the concentrated inks and the carrier. Here, the liquid developers are solutions made by mixing, in predetermined proportions, the concentrated inks composed of powder toners and are supplied from the ink cartridges and liquid carrier supplied from the carrier cartridge. The toners include pigments exhibiting colors of yellow, magenta, cyan, and black, respectively.

However, since the above cartridges supply the concentrated inks or the carrier contained therein to the developing unit via a predetermined passage and a pump, there is a disadvantage in that the passage between the cartridge and the developing unit is long. Also, although the cartridge has a characteristic of a consumable part, a functional part such as an agitator must be installed so that the contents stored in the cartridge do not precipitate. Therefore, the conventional ink delivery system has a disadvantage in which the system is expensive.

In order to reduce the cost thereof, various ink delivery systems have been proposed recently, in which tanks are provided in the vicinity of a developing unit, the functional part such as an agitator can be omitted, and a refill cartridge is installed at the outside of a main body of a printer for supplying a carrier or inks to the tanks.

In a liquid developer circulation process of an ink delivery system, liquid developer which has been recovered at a corresponding circulation tank via a development gap of a developing unit and a drying/condensing unit is transferred from one developing unit to another neighboring developing unit by a circulating photosensitive medium, and is mixed with a different liquid developer. Such a developer mixing event is referred to as cross contamination. Therefore, when printing jobs are repeatedly performed, the purity of the liquid developers of the tanks is not maintained within an allowable range due to the cross contamination, and the liquid developers stored in the circulation tanks become unusable waste developer. Under this situation, the waste developer must be discharged out of the circulation tank, and new inks and new carrier are refilled to fill liquid developers within the allowable purity range. Thus, a waste tank is installed at a printing device for recovering waste developer within the circulation tank. On the other hand, although the waste developer in the waste tank can be recovered to a separate waste bottle installed at the printing device, a method of recovering waste developer by using an empty refill cartridge corresponding to a tendency in which an ink delivery system employs a refill cartridge is under consideration.

SUMMARY OF THE INVENTION

To solve the above problems, it is an objective of the present invention to provide a liquid developer refilling system of a liquid electrophotographic printer, in which the structure thereof is improved so that in the case that any one of concentrated inks and a liquid carrier stored in a cartridge is refilled to a corresponding ink tank and a carrier tank equipped within the main body of the printer, when any one of ink refill cartridges storing yellow, magenta, cyan, and black inks, respectively, a carrier refill cartridge and an empty cartridge is installed at a common installation portion, a corresponding valve of a plurality of valves installed at a valve block can be automatically connected to the cartridge, and a method thereof.

Accordingly, to achieve the above objective, there is provided a liquid developer refilling system of a liquid electrophotographic printer for refilling any one of concentrated inks and a carrier to a corresponding ink storage tank and a carrier storage tank installed in the printer, comprising: a main frame provided with a common installation portion; an auxiliary frame installed to be movable with respect to the main frame; a cartridge installed at the installation portion and provided with a discharge hole through which a concentrated ink or carrier is discharged by compressed air; a fastener for fixing the cartridge installed at the installation portion to the main frame; a valve unit provided with a plurality of valves which can be selectively matched with the discharge hole and installed to be movable with respect to the auxiliary frame; and a valve raising/lowering mechanism which raises or lowers the auxiliary frame with respect to the main frame to connect or disconnect a corresponding valve to or from the discharge hole.

Here, the valve unit comprises: a disc provided with the plurality of valves which are installed at predetermined positions and can be selectively matched with the discharge hole, and being rotatable with respect to the auxiliary frame; disc supporter portions installed at the auxiliary frame to support the disc; and a disc rotating portion installed at the auxiliary frame to rotate the disc.

In addition, the valve unit may comprise: a slider provided with the plurality of valves which are installed at predetermined positions and can be selectively matched with the discharge hole, and being horizontally movable with respect to the auxiliary frame; and a slider mechanism which moves the slider horizontally with respect to the auxiliary frame.

On the other hand, the valve raising/lowering mechanism comprises: supporter portions formed at the auxiliary frame to be projected therefrom; a cam shaft rotatably installed at the main frame; cam members installed on the cam shaft to contact the supporter portions; and a cam driving portion installed at the main frame so as to transfer a rotational force to the cam shaft.

The fastener comprises: a cap installed at the cartridge so as to surround the discharge hole; and an engagement portion formed at the inside of the installation portion for the cap to be assembled.

In addition, the fastener comprises: a cap at which an engagement portion is formed and which is installed at the cartridge so as to surround the discharge hole; lockers installed at the main frame to be movable so as to be engaged with the engagement portion; and locker moving portions for moving the lockers with respect to the main frame.

A cartridge guide installed at the main frame is further comprised for guiding the cartridge being inserted into the installation portion.

The plurality of valves include at least two valves, which are comprised of a concentrated ink valve for refilling a concentrated ink stored in the cartridge; and a carrier valve for refilling the carrier stored in the cartridge to the printer.

In addition, to achieve the above objective, there is provided a liquid developer refilling method of a liquid electrophotographic printer for refilling any one of concentrated inks and a carrier from a ink cartridge or carrier cartridge installed to be replaceable at the printer to a corresponding ink storage tank and a carrier storage tank installed in the printer by using a liquid developer refilling system comprising a main frame provided with a common installation portion; an auxiliary frame installed to be movable with respect to the main frame; a cartridge installed at the installation portion and provided with a discharge hole through which a concentrated ink or carrier is discharged by compressed air; a fastener for fixing the cartridge installed at the installation portion to the main frame; a valve unit provided with a plurality of valves which can be selectively matched with the discharge hole and installed to be movable with respect to the auxiliary frame; and a valve raising/lowering mechanism which raises or lowers the auxiliary frame with respect to the main frame to connect or disconnect a corresponding one of the valves to or from the discharge hole, the method including the steps of: (a) determining whether necessity of refilling any one of the concentrated inks and the carrier exists; (b) inserting a cartridge corresponding to the storage tank requiring a refill into the common installation portion; (c) confirming the identity of the cartridge inserted in the installation portion; (d) matching a corresponding valve of the valves with the discharge hole of the identified cartridge; (e) fixing the cartridge to the installation portion with the fastener; (f) raising the valve unit by the valve raising/lowering mechanism so as to connect the matched valve to the discharge hole; (g) rapidly injecting the ink or carrier into the corresponding ink storage tank or carrier storage tank; (h) lowering the valve unit by the valve raising/lowering mechanism so as to disconnect the matched valve from the discharge hole; and (i) removing the cartridge from the installation portion.

BRIEF DESCRIPTION OF THE DRAWINGS

The above objectives and advantages of the present invention will become more apparent by describing in detail preferred embodiments thereof with reference to the attached drawings, in which:

FIG. 6 shows a state in which an auxiliary frame is positioned at the lowest position with respect to a main frame, FIG. 7 shows a state in which the auxiliary frame is positioned at a middle position with respect to the main frame, and FIG. 8 shows a state in which the auxiliary frame is positioned at the highest position with respect to the main frame;

DESCRIPTION OF THE PREFERRED EMBODIMENTS

Figure 1:
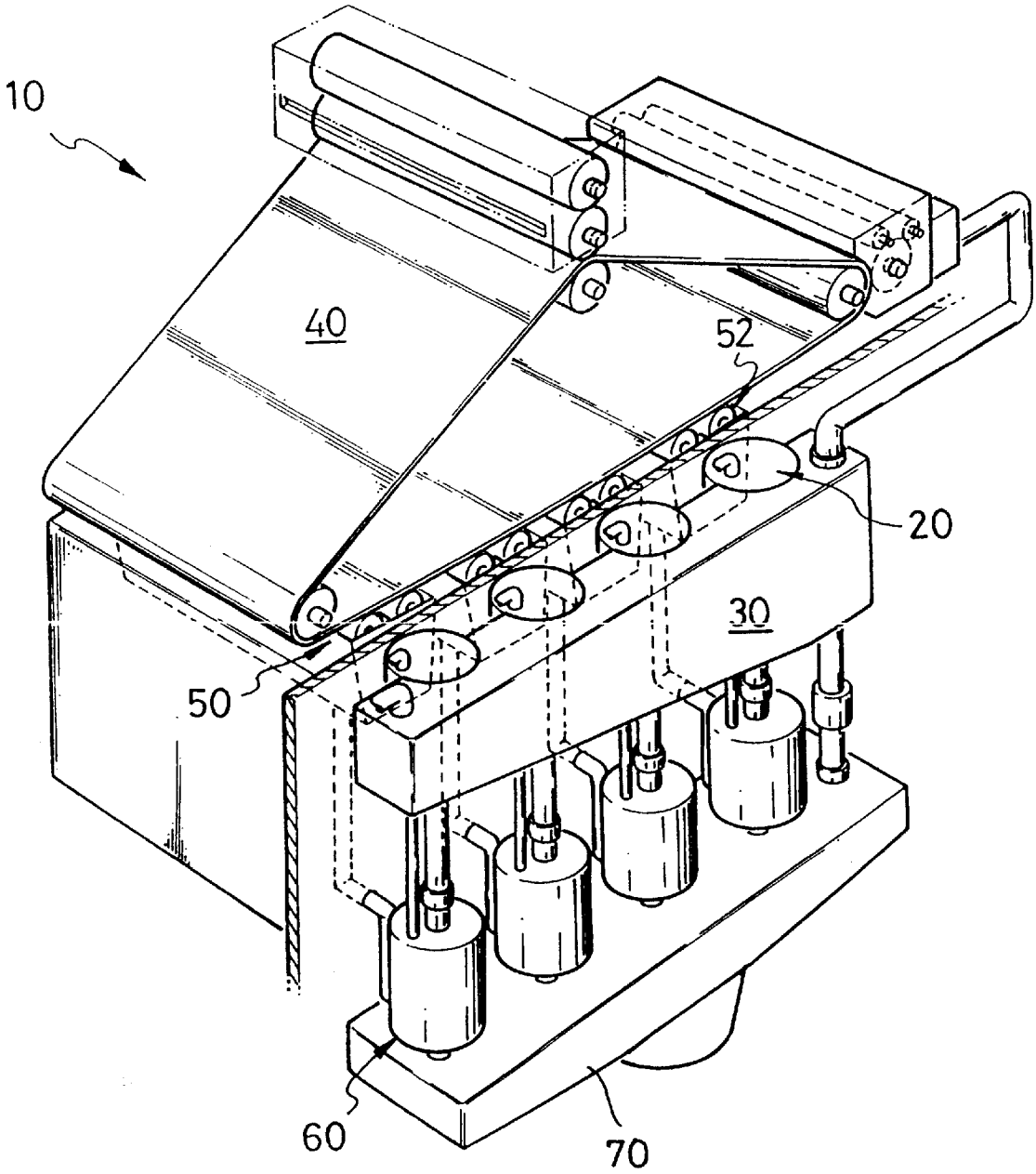
FIG. 1 is a rear side perspective view schematically illustrating a printing device to which a liquid developer refilling system of a liquid electrophotographic printing device according to a preferred embodiment of the present invention can be applied.

FIG. 1 is a rear side perspective view schematically illustrating a printing device to which a liquid developer refilling system of a liquid electrophotographic printing device according to a preferred embodiment of the present invention can be applied.

Referring to FIG. 1, a printing device 10 includes four ink storage tanks 20 for storing yellow, magenta, cyan, and black inks, a carrier storage tank 30 for storing a carrier, four developing units 50 closely installed below a photosensitive medium 40, circulation tanks 60 for supplying liquid developers to the respective developing units 50, and a waste tank 70 installed below the circulation tanks 60.

The concentrated inks stored in the ink storage tanks 20 and the carrier stored in the carrier storage tank 30 are supplied to the corresponding circulation tanks 60 to form liquid developers having a predetermined concentration, and the developers within the circulation tanks 60 are sprayed between developing rollers 52 installed in the developing units 50 and the photosensitive medium 40. Individual portions of the liquid developers so sprayed are used in development at the photosensitive medium 40, and the leftover developers stagnate at the lower portions of the developing units 50. The developers stagnating at the lower portions of the developing units 50 are recovered back to the circulation tanks 60. Therefore, in the developer refilling system of the printing device, the developers are circulated. On the other hand, when the developers within the circulation tanks 60 are contaminated by cross contamination, waste developer within the circulation tanks 60 is discharged to the waste tank 70.

Figure 2:
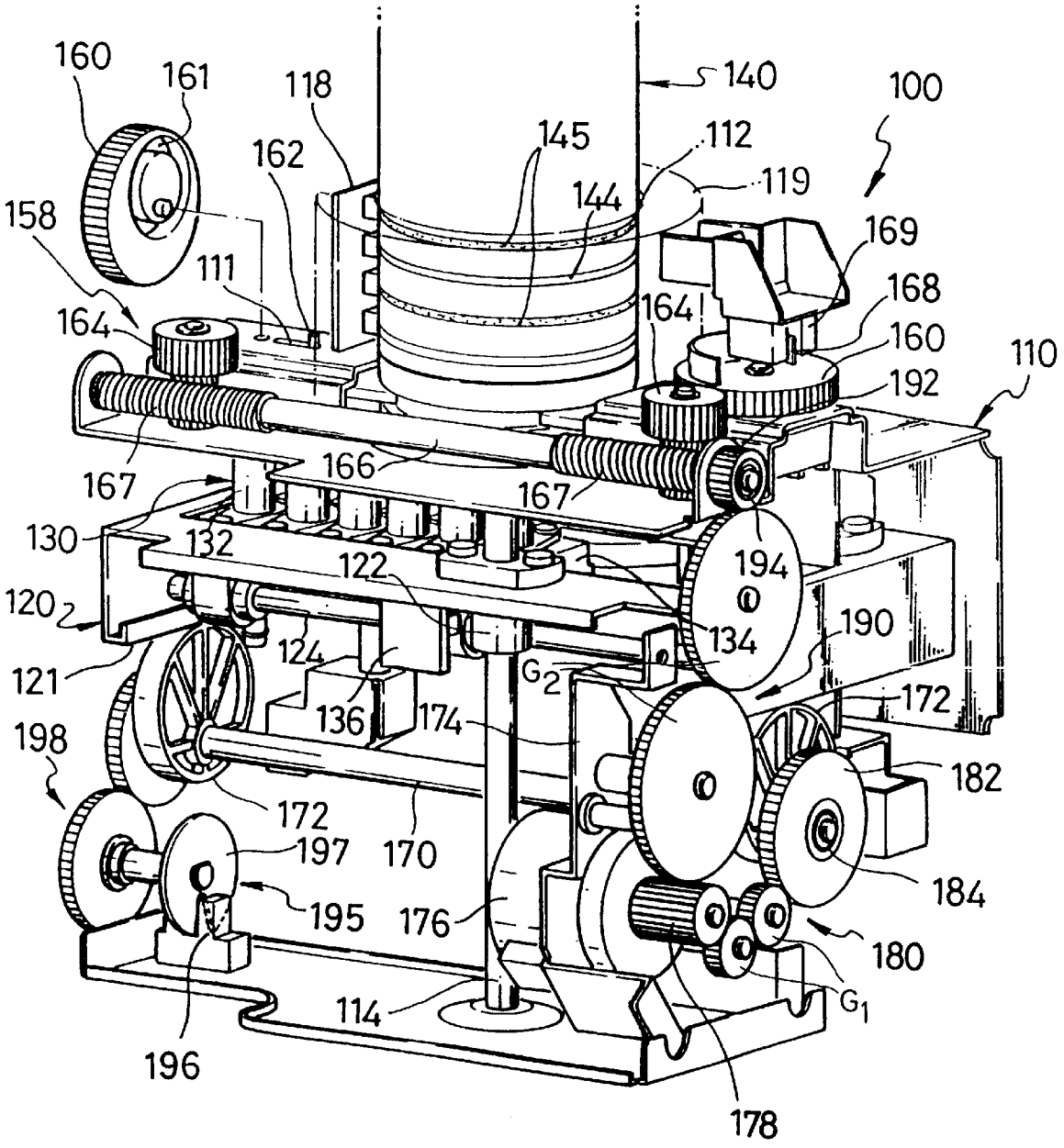
FIG. 2 is a perspective view schematically illustrating a liquid developer refilling system of a liquid electrophotographic printing device according to a preferred embodiment of the present invention.

FIG. 2 is a perspective view schematically illustrating a liquid developer refilling system of a liquid electrophotographic printing device according to a preferred embodiment of the present invention.

A liquid developer refilling system 100 is positioned at the rear and upper portion of the printing device 10 of FIG. 1, the main role of the system 100 is to supply concentrated inks or a carrier stored in a cartridge 140 to the ink storage tanks 20 (FIG. 1) and the carrier storage tank 30 (FIG. 1), respectively, and the system 100 may, if necessary, be used for recovering waste developer stored in the waste tank 70 (FIG. 1) to an empty cartridge.

As shown in FIG. 2, the system 100 comprises a main frame 110, an auxiliary frame 120 being vertically movable with respect to the main frame 110, a valve unit 130 being horizontally movable with respect to the auxiliary frame 120, the cartridge 140 installed at an installation portion 112 of the main frame 110, a fastener 150 (FIG. 4) for fastening the cartridge 140 to the installation portion 112, and a valve raising/lowering means for moving the valve unit 130 vertically.

A plurality of guide shafts 114 are installed vertically at the main frame 110. Guide flanges 122 are installed around the guide shafts 114. The guide flanges 122 are fixed to the auxiliary frame 120 and guide the vertical movement of the auxiliary frame 120 with respect to the main frame 110.

Figure 3:
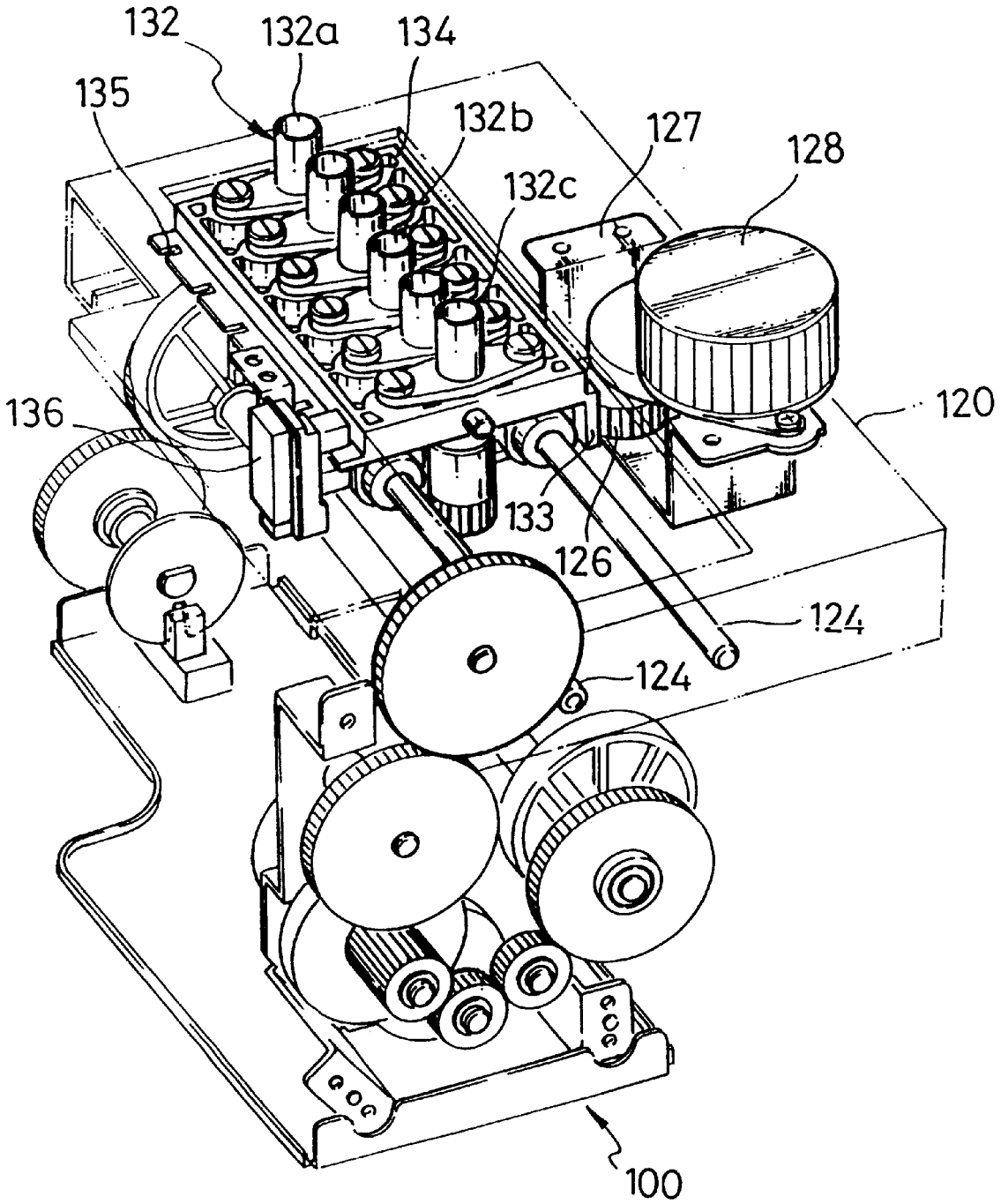
FIG. 3 is a perspective view selectively illustrating a slider portion of the refilling system shown in FIG. 2.

As shown in FIGS. 2 and 3, the valve unit 130 comprises a slider 134 on which a plurality of valves 132 are installed linearly, and a slider moving means for moving the slider 134. The slider 134 is moved horizontally with respect to the auxiliary frame 120 so as to selectively match one of the valves 132 with a discharge hole 142 (FIG. 4) of the cartridge 140 installed at the installation portion 112. The valves 132 are comprised of four ink supplying valves 132*a*, one carrier supplying valve 132*b*, and one waste developer valve 132*c*, and the valves 132 have a well-known quick valve structure.

As shown in FIG. 3, the slider moving means or mechanism includes a pair of guide rods 124 which are installed at the auxiliary frame 120 and on which the slider 134 is assembled, a slider rack portion 133 formed in a lengthwise direction of the slider 134, a slider pinion 126 meshing with the slider rack portion 133 to be rotated, a slider bracket 127 installed on the auxiliary frame 120, and a slider driving motor 128 installed at the slider bracket 127. A known stepper motor is used as the slider driving motor 128.

The slider 134 is set to be moved a desired length by a predetermined number of rotations of the slider driving motor 128. However, slider mark portions 135 are formed in the lengthwise direction of the slider 134 so as to precisely sense the positions of the valves 132 and to precisely match a corresponding valve 132 with the discharge hole 142. A slider position sensor 136 is installed at the auxiliary frame 120 for sensing the slider mark portions 135.

The cartridge 140 is a concentrated ink or carrier refill cartridge having predetermined dimensions. Therefore, the content of the cartridge may be one of the concentrated inks of four colors or a carrier. In addition, compressed air is stored in the cartridge 140 together with the content thereof. Therefore, when the valve unit 130 is raised and the valve 132 presses the discharge hole 142, the carrier or concentrated ink stored in the cartridge 140 is rapidly discharged from the cartridge 140 due to the pressure via the discharge hole 142.

The system 100 is provided with a cartridge recognizing means for recognizing whether the cartridge 140 stores a concentrated ink or the carrier, and whether the cartridge is an empty cartridge or a cartridge of a different type which cannot be applied to this system.

Figure 4:
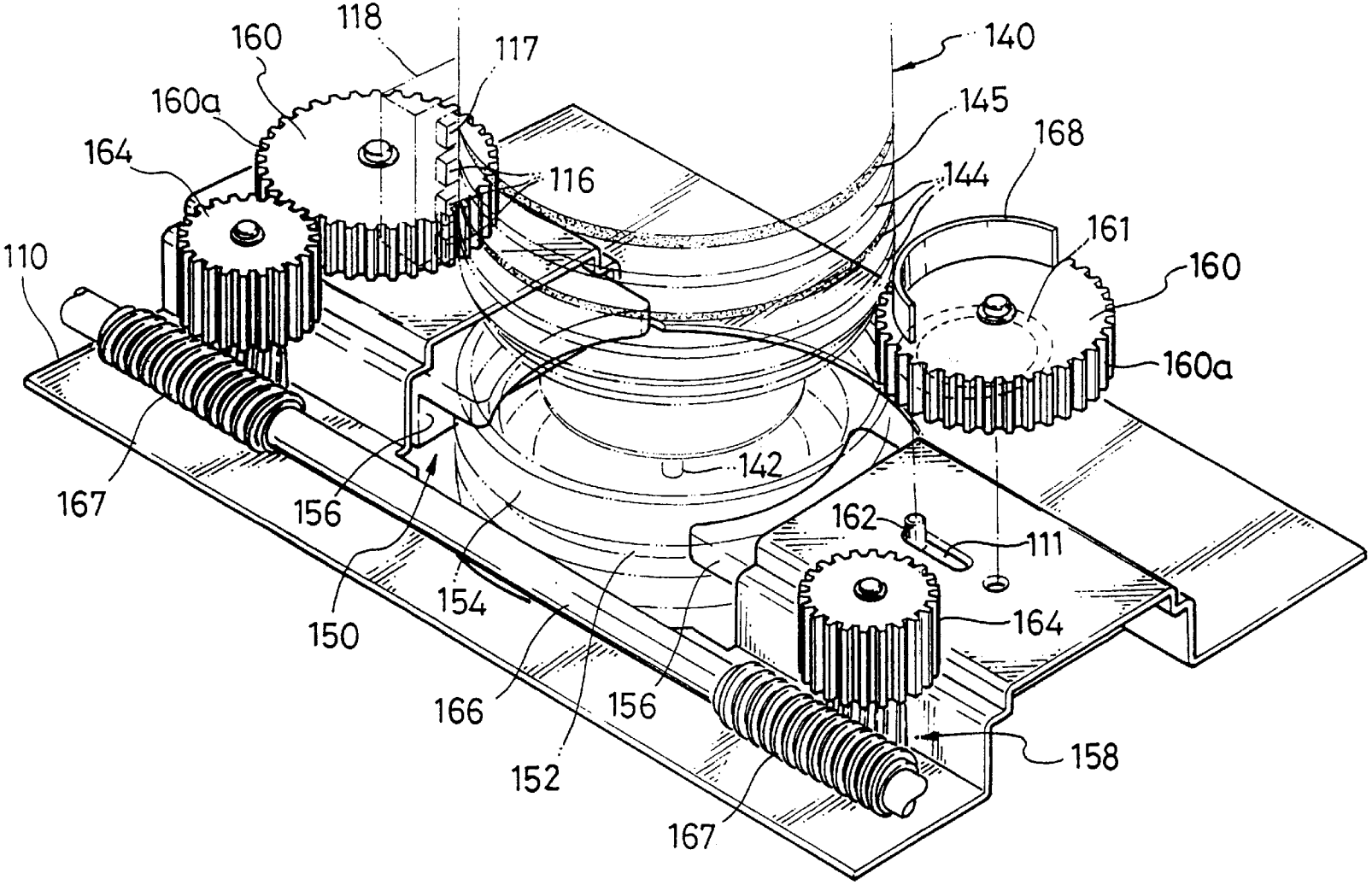
FIG. 4 is a perspective view selectively illustrating a fastener portion of the refilling system shown in FIG. 2.

As shown in FIG. 4, the cartridge recognizing means includes four lustrous line mark portions 144 provided at predetermined positions of the surface of the cartridge 140 which are treated to be lusterless so that lustrous lines 145 can be marked at four different positions according to the identity of the content of the cartridge 140, and a sensor block 118 provided with sensors 116 installed at positions corresponding to the lustrous line mark portions 144.

The sensors 116 first recognize whether the content of the cartridge 140 is a carrier or a concentrated ink according to the combination of whether each of the lustrous lines 145 marked in the lustrous line mark portions 144 exists or not, and the positions of the lustrous lines 145. Then, the sensors 116 recognize the color of the concentrated ink if a concentrated ink is stored in the cartridge 140. Here, one of the sensors 116 is a spare sensor 117 for replacing a malfunctioning sensor when one of the sensors 116 malfunctions.

An example of the logic structure of a system controlling portion in which the sensors 116 confirm the identity of the cartridge 140 according to the combination of whether each of the lustrous lines 145 exists or not, and the positions of the lustrous lines 145, is shown in the following Table 1. According to Table 1, the identity of the cartridge 140 can be determined by only three sensors, and in addition, even if one of the sensors 116 malfunctions, the identities of five cartridges 140 can be recognized by means of the spare sensor 117. For example, when sensors 1 and 2 are "on", and sensors 3 and 4 are "off", the content of the cartridge 140 is recognized as a concentrated ink of a yellow color.

TABLE 1

| | | | | | |
|---|---|---|---|---|---|
| Sensor 1 | on | on | off | off | off |
| Sensor 2 | on | off | on | on | off |
| Sensor 3 | off | on | on | off | on |
| Sensor 4 | off | off | off | on | on |
| Result | yellow | magenta | cyan | black | carrier |

As shown in FIG. 2, the installation portion 112 is formed on the main frame 110, a cartridge guide 119 is installed around the installation portion 112 so as to guide a cartridge 140 inserted in the installation portion 112. The sensor block 118 is installed at the cartridge guide 119.

As shown in FIGS. 2 and 4, the fastener 150 comprises a cap 154 installed at the cartridge 140 around the discharge hole 142, an engagement portion 152 formed around the outer circumferential surface of the cap 154, a pair of lockers 156 installed at both sides of the installation portion 112 to be inserted into the engagement portion 152, and locker moving portions 158 for moving the lockers 156 with respect to the main frame 110, respectively.

Figure 5:
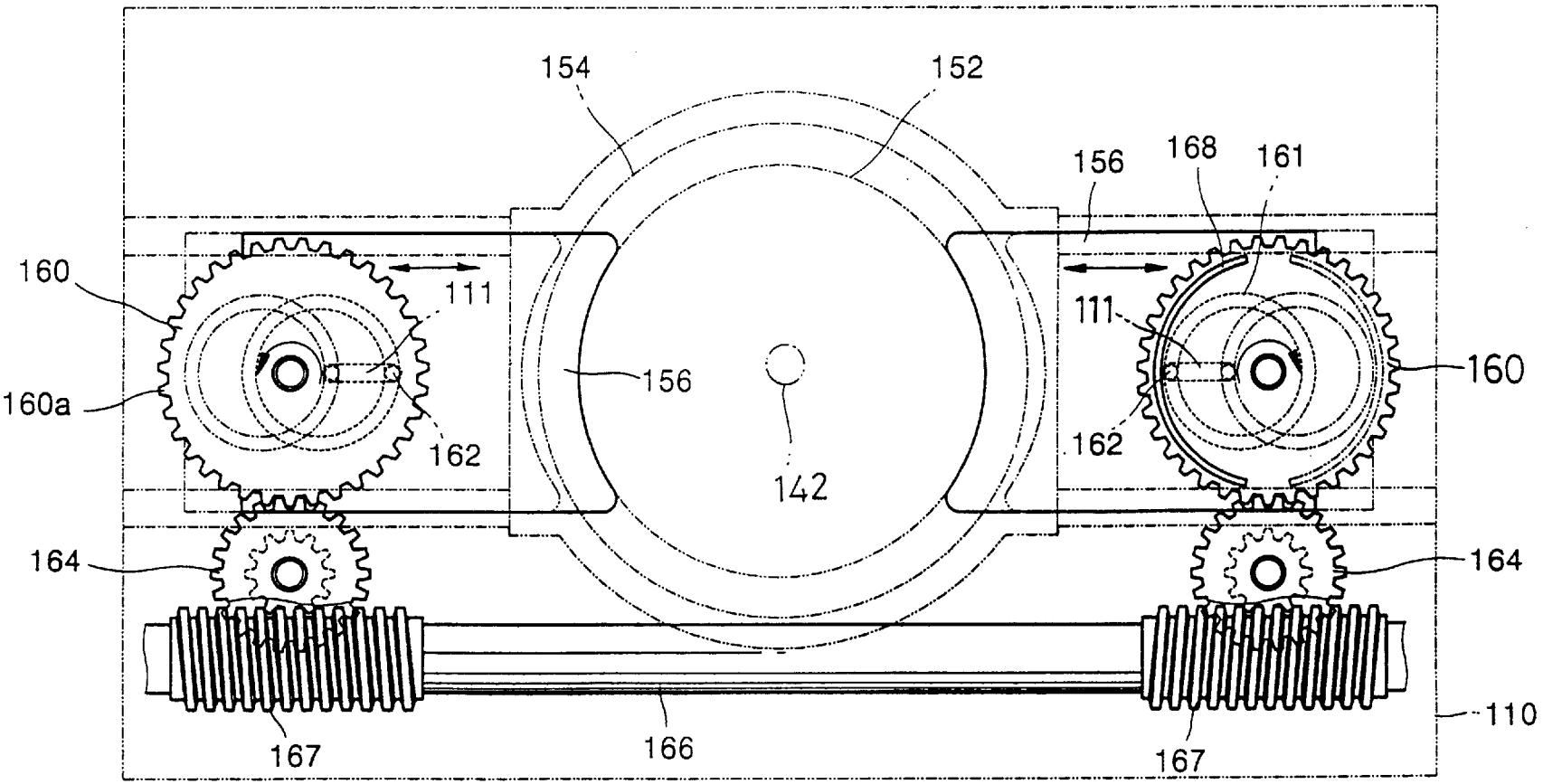
FIG. 5 is a plan view illustrating the fastener portion shown in FIG. 4.

The locker moving portion 158 comprises a locker cam 160, a cam pole 162, a worm gear, and a worm driving means. The worm gear is comprised of a worm wheel 164 and a worm 166. The locker cam 160 is rotatably installed at both sides of the main frame 110. A cam groove 161 of a predetermined shape is formed at the lower surface of the locker cam 160, and a locker cam gear 160*a* is formed at the outer circumference of the locker cam 160. The cam pole 162 is installed at the locker 156 so as to pass through an elongated locker hole 111 formed at the main frame 110. One end of the cam pole 162 is inserted into the cam groove 161. A pair of worm portions 167 are installed at the ends of the worm 166. Spiral threads are symmetrically formed at the worm portions 167. Therefore, when the worm 166 rotates, as shown in FIG. 5, the pair of locker cams 160 are rotated in directions opposite to each other, and the cam poles 162 are moved to be close to or far away from each other with respect to the elongated locker holes 111. Then, the pair of lockers 156 installed symmetrically approach or are separated from each other with reference to the discharge hole 142. The worm moving means will be described later.

As shown in FIG. 2, a locker position sensing means for sensing whether the cap 154 and the locker 156 are engaged with or disengaged from each other comprises a semicircular projection member 168 installed to be projected on the locker cam 160, and a locker cam sensor 169 installed at the cartridge guide 119 of the main frame 110 so as to respond according to the rotational position of the projection member 168. The locker cam sensor 169 is a usual reflected light sensor.

As shown in FIG. 2, and FIGS. 6 through 8, the valve raising/lowering means or mechanism comprises supporter portions 121 formed at the auxiliary frame 120, a cam shaft 170 installed at the main frame 110, cam members 172 installed on the cam shaft 170, and a cam driving portion for rotating the cam shaft 170. Here, the supporter portions 121 are formed at both ends of the auxiliary frame 120 to be projected downward, and each of the supporter portions 121 has a contact portion contacting the cam member 172. The cam shaft 170 is installed horizontally at the main frame 110, and the cam member 172 has a predetermined cam shape to contact the contact portion.

The cam driving portion comprises a cam driving motor 176 installed at a cam driving motor bracket 174 installed at the main frame 110, and a first power transfer system 180 connecting the cam shaft 170 and the cam driving motor 176.

The cam driving motor 176 additionally performs the function of the above-described worm driving means. Therefore, the system 100 comprises double power transfer systems. That is, the system 100 comprises a first power transfer system 180 for rotating the cam members 172 and a second power transfer system 190 for rotating the worm 166.

The first power transfer system 180 comprises a first gear 178 installed on the rotating shaft of the cam driving motor 176, a second gear 182 installed on one end of the cam shaft 170, and a first train of gears $G_1$ installed between the first gear 178 and the second gear 182. The second power transfer system 190 comprises the first gear 178, a third gear 192 installed on the shaft of the worm 166, and a second train of gears $G_2$ installed between the first gear 178 and the third gear 192. Here, a first one-way bearing 184 is installed between the second gear 182 and the cam shaft 170, and a second one-way bearing 194 is installed between the third gear 192 and the worm 166. The one-way bearings 184 and 194 are intended to selectively rotate the cam shaft 170 or the worm 166 according to the rotation or reverse rotation of the cam driving motor 176.

On the other hand, the valve unit position sensing portion 195 for sensing the vertical position of the auxiliary frame 120 moving vertically with respect to the main frame 110 comprises a valve unit position sensor 196 installed at the main frame 110, and a marking member 197. It is preferable that the marking member 197 is a disc member in which a slit is formed at a predetermined position thereof so that the vertical position of the upper and lower portions of the auxiliary frame 120 can be sensed. In addition, the marking member 197 is installed to be moved simultaneously by a train of gears 198 installed at the main frame 110, and therefore to be rotated by the cam shaft 170. The valve unit position sensor 196 is positioned on the rotational track of the marking member 197, and senses the vertical position of the auxiliary frame 120 according to the passage of the slit. A known reflected light sensor is used as the valve unit position sensor 196.

Figure 7:
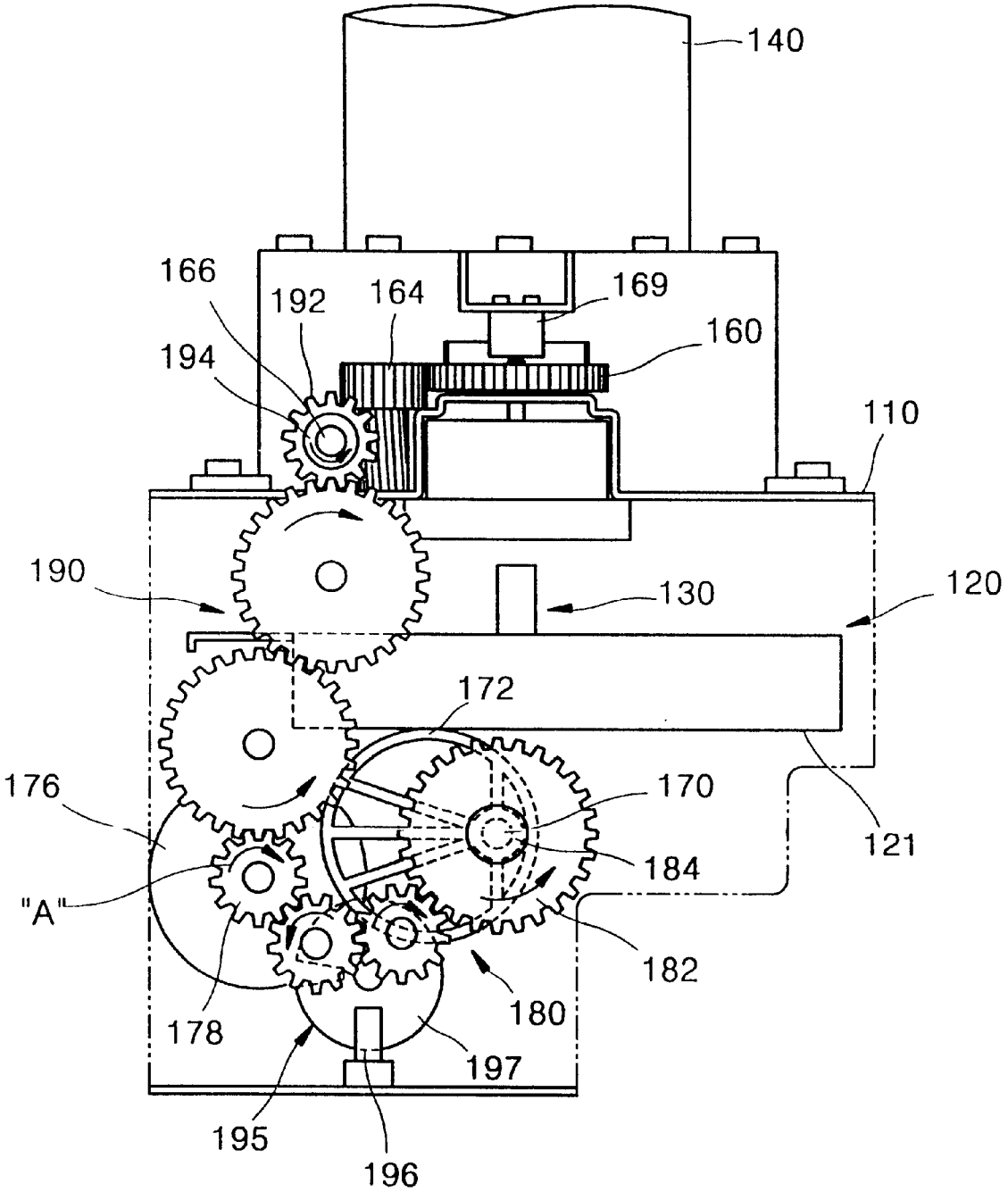
Figure 8:
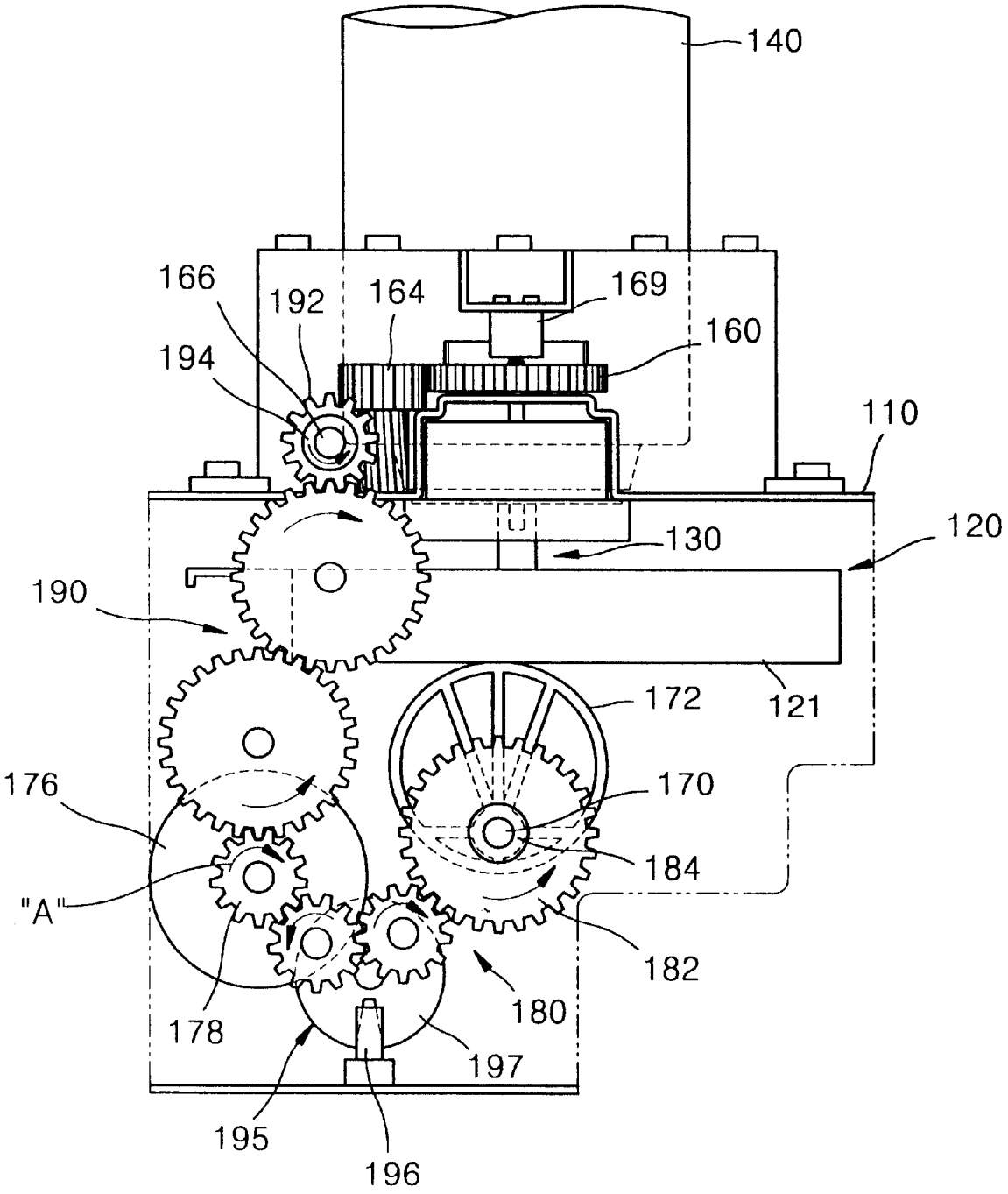

The operation of the liquid developer refilling system having the above-described structure according to this embodiment will now be described with reference to FIG. 2, and FIGS. 6 through 8. Here, FIG. 6 shows a state in which the valve unit 130 is positioned at the lowest position with respect to the main frame 110, FIG. 7 shows a state in which the valve unit 130 is positioned at a middle position with respect to the main frame 110, and FIG. 8 shows a state in which the valve unit 130 is positioned at the highest position with respect to the main frame 110.

First, the remaining quantities of the concentrated inks and the carrier stored in the ink storage tanks 20 (FIG. 1) or the carrier storage tank 30 (FIG. 1) are inspected by level sensors (not shown) installed at the tanks 20 and 30, respectively. If the level information is "low level" or "empty", the system controlling portion (not shown) generates a message such as "cartridge requiring flag" so as to compensate for a concentrated ink or the carrier to a corresponding tank. Here, the tank requiring the compensation of the content may be an ink storage tank or the carrier storage tank. If the concentrated ink of one of the ink storage tanks 20 must be compensated for, the color of the ink, i.e., yellow, magenta, cyan or black is determined.

Subsequently, a user installs a corresponding cartridge 140 to the installation portion 112 via the cartridge guide 119. Then, the system controlling portion operates the three sensors 116 installed at the sensor block 118 to determine whether the cartridge 140 installed at the installation portion 112 corresponds to the tank requiring compensation according to the existence of the lustrous lines 145 marked on the lustrous line mark portions 144 formed on the lusterless surface of the cartridge 140. If the cartridge 140 does not correspond to the tank requiring the compensation, the information corresponding to this is sent to the system controlling portion, and the system controlling portion informs the user of information concerning the erroneous installation of the cartridge 140, and when the right cartridge is installed, the following step will be performed.

Figure 6:
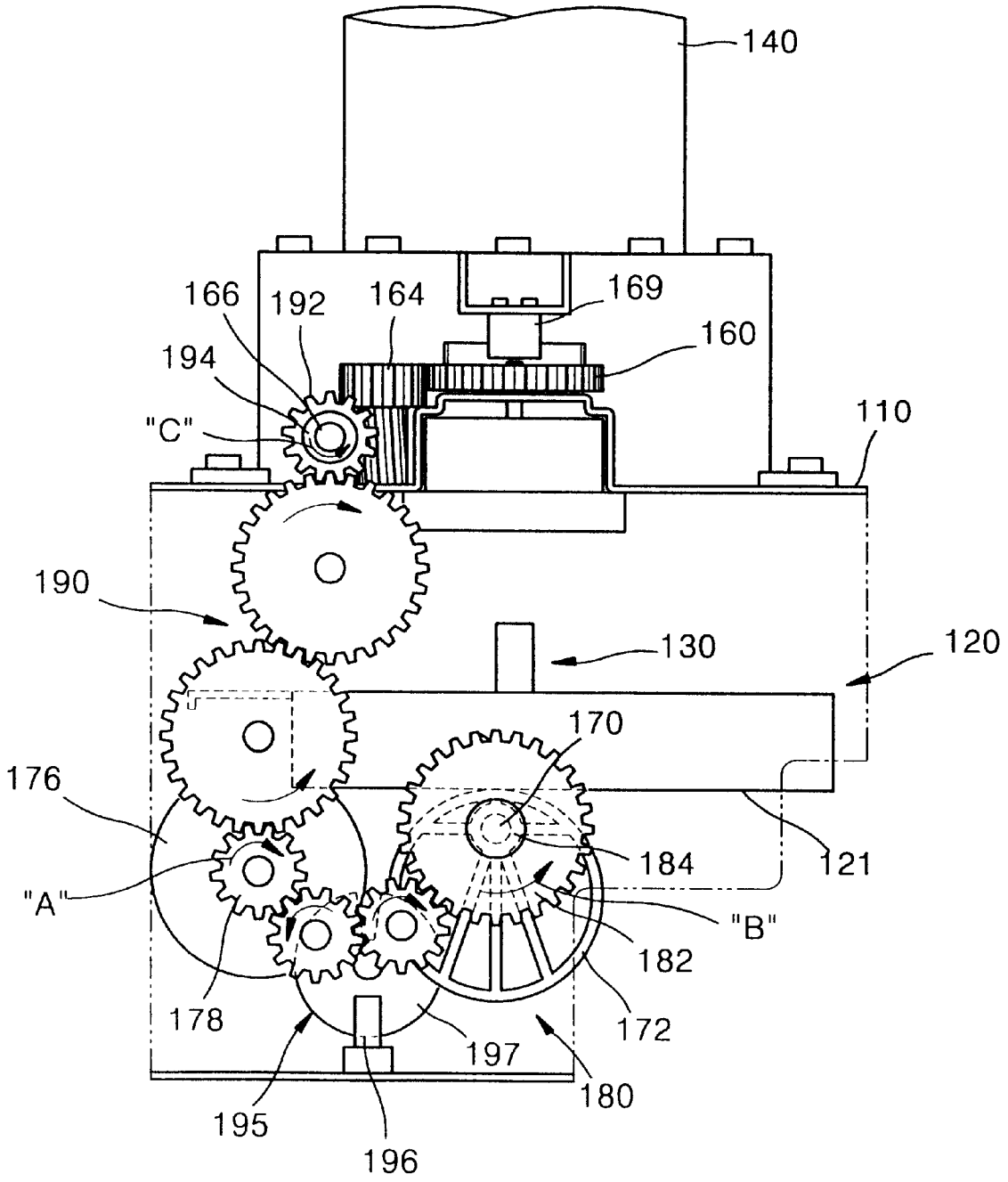
FIGS. 6 through 8 are right side views of the refilling system shown in FIG. 2 for describing the operation of a refilling system of the present invention.

Next, as shown in FIG. 6, in order to fix the cartridge 140 to the main frame 110, the cam driving motor 176 is rotated in a clockwise direction in FIG. 6. Then, the first gear 178 installed on the rotating shaft of the cam driving motor 176 is rotated in the direction indicated by arrow A, and the rotational force thereof is transferred to the first power transfer system 180 and the second gear 182 is rotated in the direction indicated by arrow B. However, the cam shaft 170 is not rotated because of the first one-way bearing 184 installed in the second gear 182. Therefore, the valve unit 130 remains in a stopped state. On the other hand, the rotational force of the cam driving motor 176 rotates the third gear 192 in the direction indicated by arrow C via the second power transfer system 190 connected to the first gear 178. Then, the second one-way bearing 194 installed in the third gear 192 rotates the worm 166 in the same direction as the third gear 192.

In this state, as shown in FIGS. 4 and 5, the pair of worm wheels 164 meshing with the worm portions 167 of the worm 166 rotate in opposite directions. Thereafter, the locker cams 160 are rotated by the rotation of the worm wheels 164, the cam poles 162 inserted in the cam grooves 161 of the locker cams 160 are moved within the elongated locker holes 111, and thus the lockers 156 are moved to the cartridge 140 with respect to main frame 110, and the lockers 156 are locked in the engagement portion 152. At the point in time when the lockers 156 are locked in the engagement portion 152 of the cap 154, the system controlling portion drives the locker cam sensor 169. Therefore, when the engagement of the lockers 156 with the engagement portion 152 is confirmed, the information concerning this is sent to the system controlling portion. Then, the system controlling portion stops the cam driving motor 176 to cause the cartridge 140 to be fixed to the main frame 110.

Subsequently, as shown in FIG. 3, the slider 134 must be moved a predetermined distance so that the valve communicating with the tank requiring the compensation can be matched with the discharge hole 142 of the cartridge 140. To this end, the slider driving motor 128 is rotated by a predetermined number of degrees with the slider 134 positioned at the initial position. Then, the slider pinion 126 is rotated, and the slider 134 is moved while being supported by the guide rods 124. Therefore, the valve communicating with the tank requiring the compensation can be matched with the discharge hole 142 of the cartridge 140. Here, the predetermined number of degrees is set to be different depending on the positions of the plurality of valves, and the slider position sensor 136 senses the exact positions of the valves 132 by the mark portions 135.

Then, the valve raising/lowering means is operated so that the content of the cartridge 140 can be supplied to the tank requiring compensation via the discharge hole 142. This operation is performed by rotating the cam driving motor 176 in a counterclockwise direction in FIG. 6 in a state in which the auxiliary frame 120 is lowered to the lowest position with respect to the main frame 110. Then, whereas the rotational force of the cam driving motor 176 transferred via the second power transfer system 190 is blocked by the second one-way bearing 194 installed on the worm 166, the rotational force of the cam driving motor 176 transferred via the first gear 178 and the first power transfer system 180 rotates the second gear 182 in the opposite direction of arrow B, and rotates the cam shaft 170 in the same direction by the first one-way bearing 184. Then, the cam member 172 is rotated in the opposite direction of arrow B to raise the supporter portions 121 of the auxiliary frame 120, and as shown in FIG. 8, stops the cam driving motor 176 in a state in which the cam members 172 position the auxiliary frame 120 at the highest position. Then, the discharge hole 142 of the cartridge 140 and the valve 132 are connected, and the content stored in the cartridge 140 is discharged through the valve 132 by the pressure of the compressed air, and rapidly supplied to the tank requiring compensation.

Next, after the tank is compensated for, the cam driving motor 176 is further rotated counterclockwise until the auxiliary frame 120 reaches the lowest position. Then the valve 132 connected to the discharge hole 142 is lowered. On the other hand, the slider 134 moved by the predetermined distance must be returned to the original position, and to this end, the slider driving motor 128 must be rotated in a direction opposite to that of the matching operation by the same number of degrees.

Subsequently, the cam driving motor 176 is rotated clockwise so as to free the cartridge 140 from the installation portion 112. Then, the rotational force of the cam driving motor 176 is not transferred to the cam shaft 170, and rotates the worm 166 via the second power transfer system 190. Therefore, the pair of lockers 156 are moved in directions of moving away from the cartridge 140, and the locker sensor 169 is operated to stop the cam driving motor 176 when the lockers 156 are at the farthest position from the cartridge 150. Thereafter, the cartridge 140 is removed from the installation portion 112 and the cartridge guide 119.

When waste liquid developer stored in the waste tank 70 (FIG. 1) increases, the waste liquid developer needs to be discharged to the outside. Such an operation of recovering the waste developer can be performed by installing an empty cartridge, or performed in a state in which after the refilling operation is completed, the empty cartridge 140 remains fixed to the installation portion 112. In this embodiment, the latter will be described as an example.

First, the auxiliary frame 120 which was raised with respect to the main frame 110 is lowered to the lowest position and returned back to the original position. Thereafter, the slider driving motor 128 is rotated a predetermined number of degrees so that the waste developer valve 132*c* can be matched with the discharge hole 142. Next, the valve unit 130 is raised as in the filling operation to connect the waste developer valve 132*c* to the discharge hole 142. In this operation, the waste developer stored in the waste tank 70 is supplied to an empty cartridge by operating a pump installed on the passage (not shown) of the waste developer.

Figure 9:
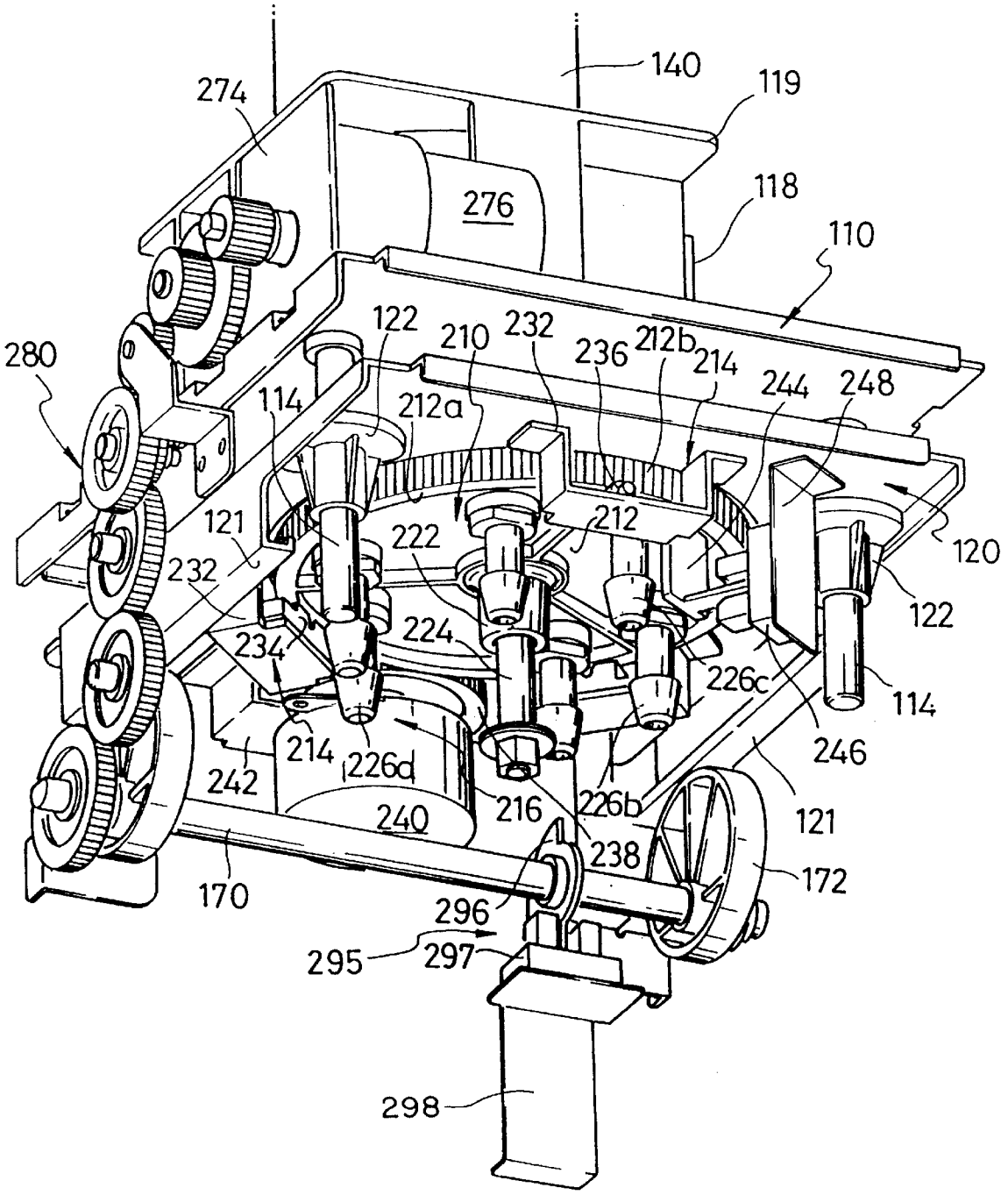
FIG. 9 is a bottom side perspective view schematically illustrating a liquid developer refilling system of a liquid electrophotographic printing device according to another embodiment of the present invention.

FIG. 9 is a bottom side perspective view schematically illustrating a liquid developer refilling system of a liquid electrophotographic printing device according to another embodiment of the present invention. The same reference numerals as in FIGS. 1 through 8 denote the same members having the same functions.

In this embodiment, a rotary type valve unit 210 is employed differently from the so-called slide type valve unit of the previous embodiment. That is, the valve unit 210 comprises a disc 212 installed to be movable vertically with an auxiliary frame 120 with respect to a main frame 110, disc supporter portions 214 for supporting the disc 212 to the auxiliary frame 120, and a disc rotating portion 216 for rotating the disc 212 with respect to the auxiliary frame 120.

A center flange 222 is installed at the center of the disc 212. A center shaft 224 installed at the main frame 110 passes through the center shaft 224. Therefore, the center shaft 224 guides the rotation and vertical movement of the disc 212. The disc 212 is positioned on the same horizontal plane as the auxiliary frame 120. Six valves 226 are installed through the disc 212 at predetermined positions. That is, concentrated ink valves 226*a* for yellow, magenta, cyan, and black inks, a carrier valve 226*b*, and a waste developer valve 226*c* are arranged so as to be selectively matched with a discharge hole 142 of a cartridge 140.

The disc supporter portions 214 are comprised of a plurality of disc brackets 232 installed at the auxiliary frame 120, roller supporting mounts 234 installed at the disc brackets 232, and rollers 236 installed on the roller supporting mounts 234 so as to roll while contacting a roller contacting portion 212*a* projected downward from the disc 212.

The disc rotating portion 216 comprises a disc gear 212*b* formed on the circumference of the disc 212, a disc driving gear 238 installed at the auxiliary frame 120 so as to mesh with the disc gear 212*b* and rotate the disc 212, and a disc driving motor 240 installed at the auxiliary frame 120 so as to rotate the disc driving gear 238. Here, the disc driving motor 240 is installed at a disc driving motor bracket 242 installed at the auxiliary frame 120, and a known stepper motor is used as the disc driving motor 240. In addition, the disc driving motor 240 is controlled by a system controlling portion to rotate a predetermined number of degrees.

In order to match a corresponding valve 226 with the discharge hole 142, the disc 212 needs to be rotated a predetermined number of degrees from a reference point (referred to as "original position"). Therefore, a disc position sensing portion is provided so as to sense the original position and a matching position of a valve 226 with the discharge hole 142.

The disc position sensing portion comprises a blade 244 installed to be projected downward from the disc 212, and a disc sensor 246 installed on the rotational path of the blade 244. Here, the disc sensor 246 is a usual reflected light sensor installed at a disc sensor bracket 248 installed at the auxiliary frame 120.

A plurality of guide shafts 114 are installed at the main frame 110. The auxiliary frame 120 is moved vertically while being guided by guide shafts 114. On the other hand, guide shaft flanges 122 are installed around the guide shafts 114, and guide the vertical movement of the auxiliary frame 120 with respect to the main frame 110. A valve raising/lowering means is provided for connecting the selected valve to the discharge hole 142 or separating the matched valve from the discharge hole 142.

The valve raising/lowering means comprises supporter portions 121 formed at the auxiliary frame 120, a cam shaft 170 installed at the main frame 110, cam members 172 installed on the cam shaft 170, and a cam driving portion.

The cam driving portion comprises a cam driving motor bracket 274 installed on the main frame 110, a cam driving motor 276 installed at the cam driving motor bracket 274, and a power transfer system 280 for transferring the rotational force of the cam driving motor 276 to the cam shaft 170.

A valve unit position sensing portion 295 for sensing the vertical position of the auxiliary frame 120 with respect to the main frame 110 comprises a mark member 296 of a semicircular disk shape installed on the cam shaft 170, and a valve unit position sensor 297 installed at a sensor bracket 298 which is in turn installed at the main frame 110, so as to sense the rotational position of the mark member 296 according to the reflected light.

Figure 10:
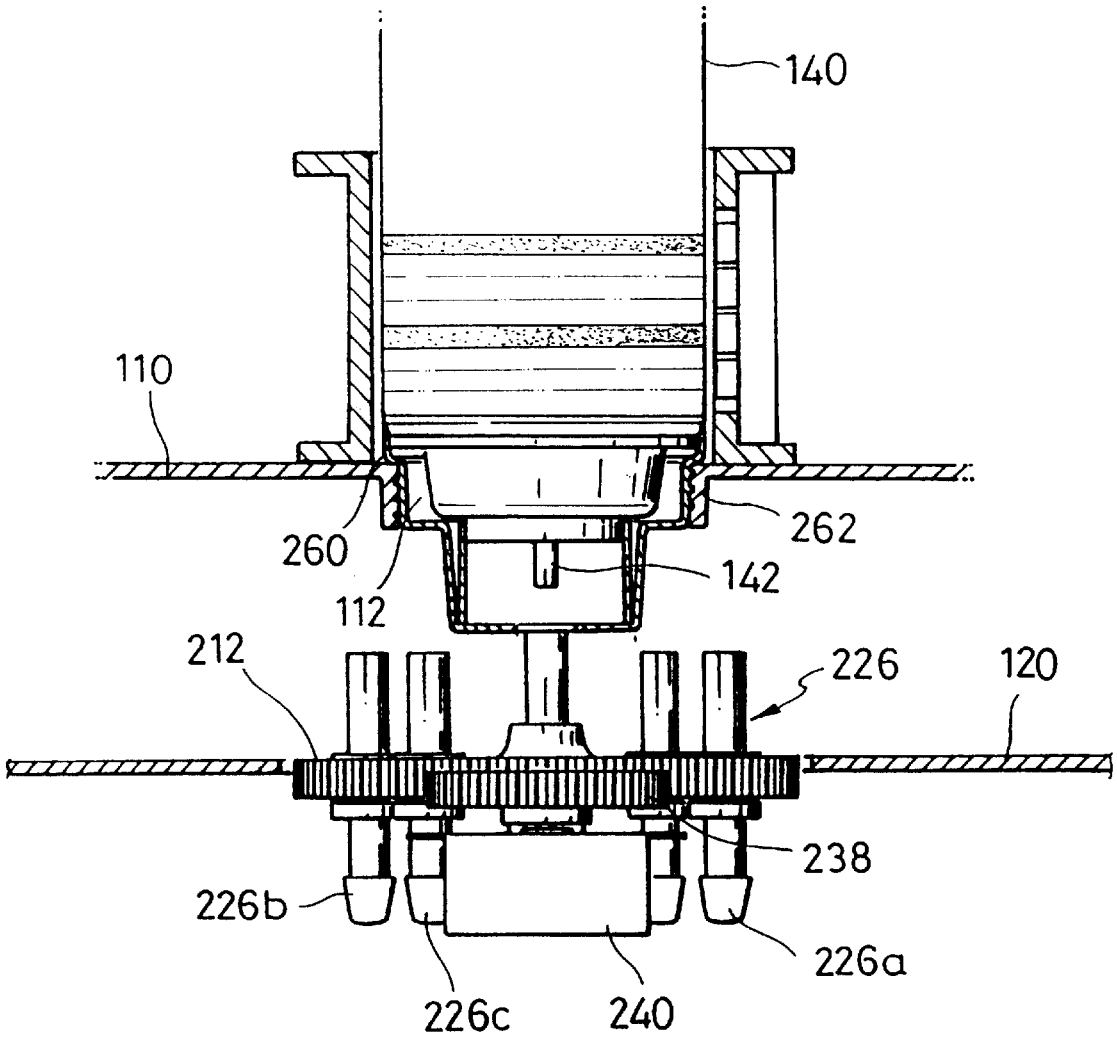
FIG. 10 is a sectional view illustrating a fastener portion shown in FIG. 9.
Figure 11:
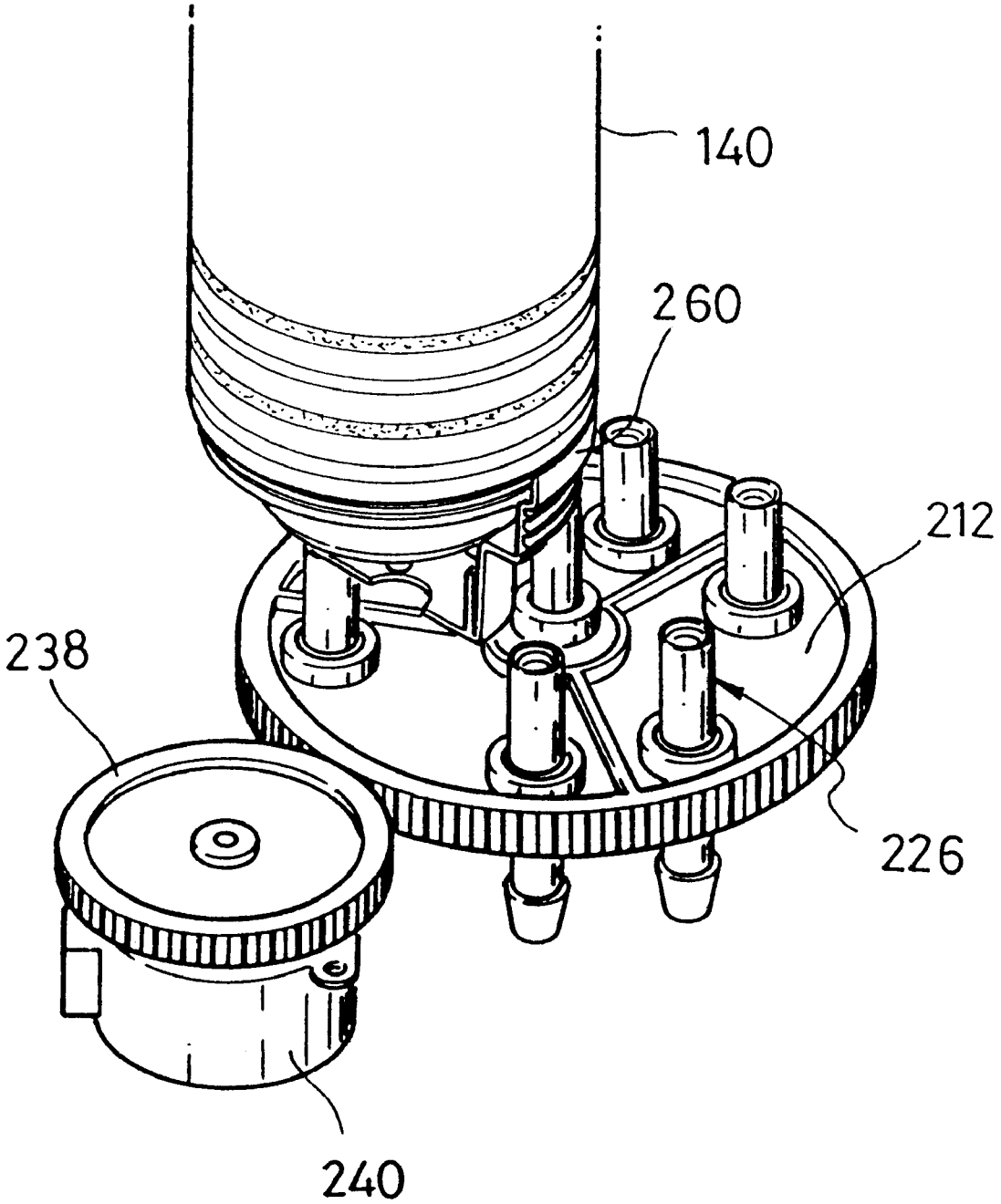
FIG. 11 is a perspective view of the fastener portion shown in FIG. 10.

As shown in FIGS. 10 and 11, in a liquid developer refilling system according to this embodiment, a cap 260 provided with a male screw portion is installed at the leading edge of a cartridge 140 for fixing the cartridge 140 to an installation portion 112, and an engagement portion 262 provided with a female screw portion is formed on the inner surface of the installation portion 112. Therefore, when the cartridge 140 installed at the installation portion 112 is rotated, the male screw portion of the cap 260 is screwed to the female screw portion of the engagement portion.

The operation of the liquid developer refilling system having the above structure according to this embodiment will be described with reference to FIGS. 9 through 13.

Similar to the description of the operation of the previous embodiment, when the identity of the cartridge 140 installed at the installation portion 112 is confirmed, the cartridge 140 is rotated to cause the cap 260 to be assembled to the engagement portion 262 and is fixed to the installation portion 112. Thereafter, in order to match the valve communicating with the tank requiring the compensation with the discharge hole 142 of the cartridge 140, the disc disposed at the initial position is rotated a predetermined angle. Here, the match position of the disc 212 is sensed by the disc position sensing portion comprising the blade 244 and the disc sensor 246. Therefore, when the disc driving motor 240 is rotated a predetermined number of degrees, the disc driving gear 238 is rotated, and the disc 212 is rotated while being supported by the rollers 236. Consequently, the valve communicating with the tank requiring the compensation is matched with the discharge hole 142. Here, it should be understood that the predetermined number of degrees is set to be different from each other depending on the peculiar position of the plurality of valves.

Figure 13:
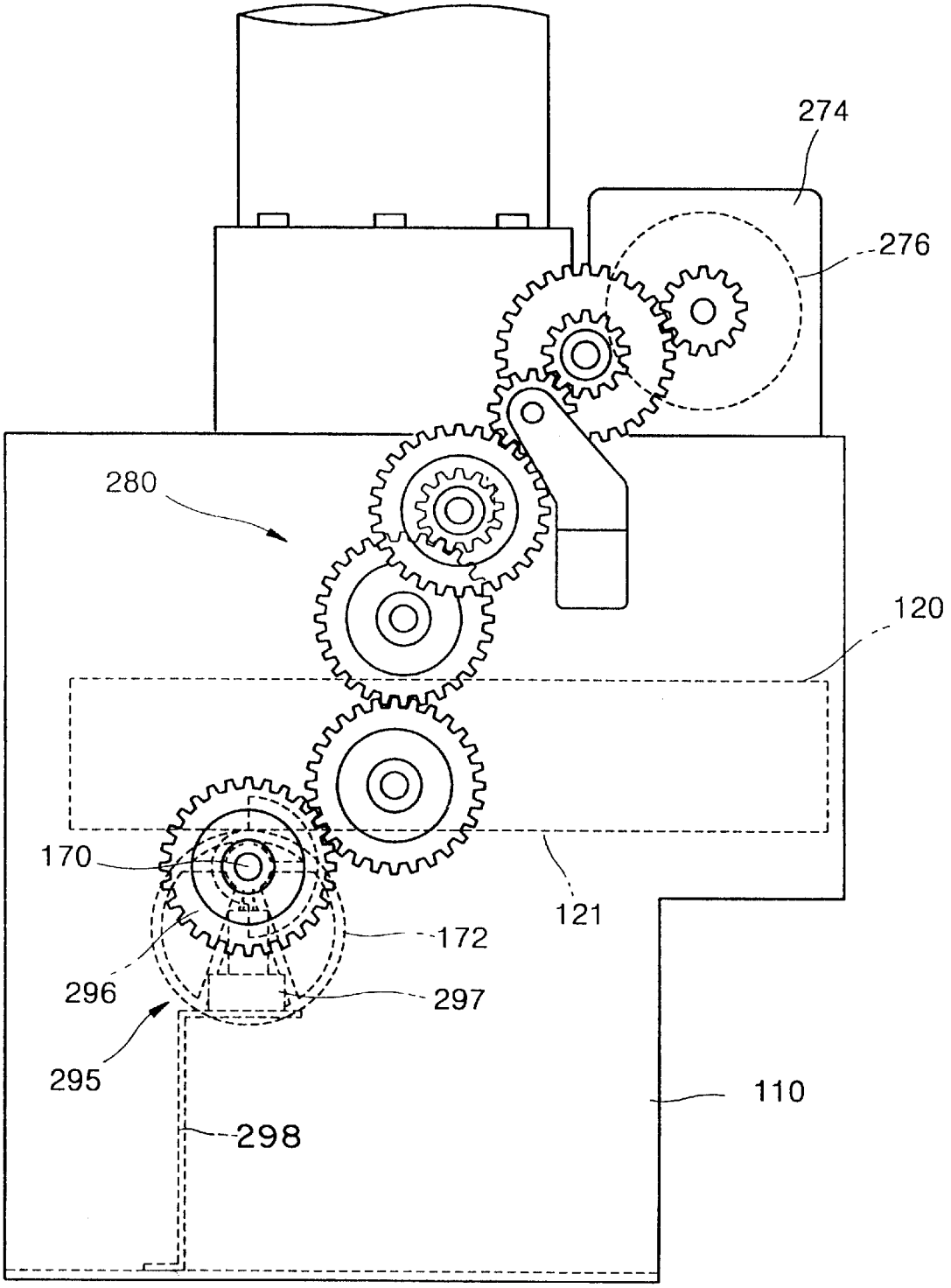

Subsequently, the valve raising/lowering means is operated so that the matched valve can be connected to the discharge hole 142 and the content of the cartridge 140 can be supplied to the tank requiring the compensation. As shown in FIG. 13, when the cam driving motor 276 is operated with the auxiliary frame 120 lowered at the lowest position with respect to the main frame 110, the rotational force rotates the cam shaft 170 via the power transfer system 280. The rotational force of the cam shaft 170 rotates the cam members 172, and the auxiliary frame 120 is raised by the supporter portions 121 contacting the rotating cam members 172. Then, as shown in FIG. 13, when the cam member 172 positions the auxiliary frame 120 at the highest position, the cam driving motor 276 stops rotating. Such stop action of the cam driving motor 276 is performed by the valve unit position sensing portion comprising the valve unit position sensor 297 and the mark member 296. Then, the discharge hole 142 of the cartridge 140 is pressed up and opened by the raised valve 226, and the content of the cartridge 140 is discharged by the compressed air via the valve 226 and is rapidly supplied to the corresponding tank.

Figure 12:
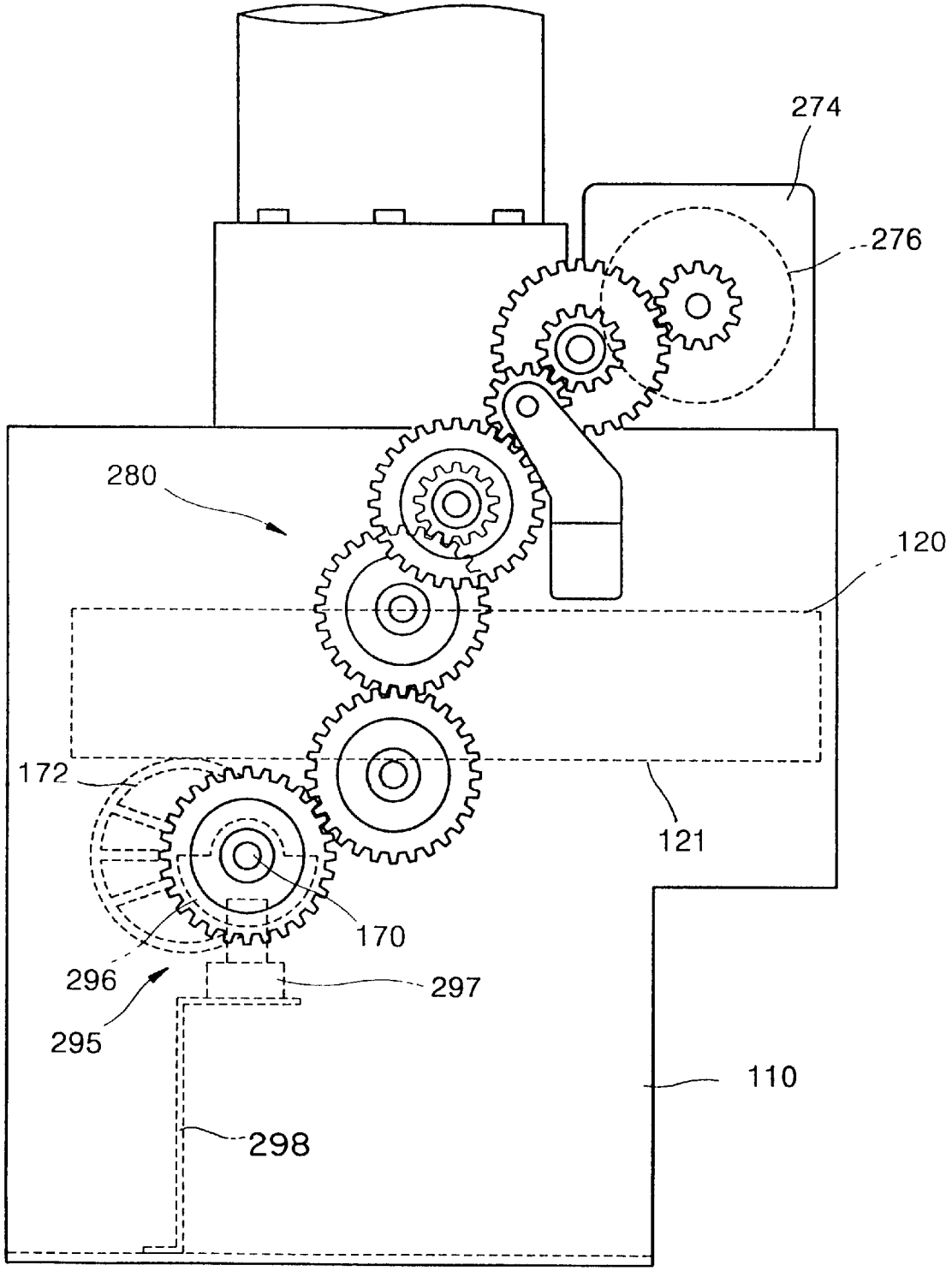
FIGS. 12 and 13 are a left side view illustrating the operation of the refilling system shown in FIG. 9.

Next, after the tank is compensated for, the disc 212 is further rotated until the auxiliary frame 120 reaches the lowest position (FIG. 13) from the highest position (FIG. 12). In this process, when the valve 226 which presses up the discharge hole 142 is lowered, the discharge hole 142 returns to the original position. On the other hand, the disc 212 which was rotated the predetermined number of degrees must be returned back to the initial position, and to this end, the disc driving motor 240 must be rotated in a direction opposite to that of the matching operation by an equal number of degrees. Also, in this operation, the disc sensor 246 disposed on the radius of rotation of the blade 244 may be operated to sense the initial position of the disc 212. In addition, the disc returning operation back to the initial position is not necessarily performed after the valve unit 210 is lowered, and may be set to be performed while the valve unit 210 is lowered.

Next, after the cartridge 140 screwed to the engagement portion 262 of the installation portion 112 is unscrewed, the cartridge 140 is removed from the installation portion 112 and the cartridge guide 119. Similar to the disc returning operation back to the initial position, the cartridge unscrewing and removing operation can be performed immediately after the valve 226 is separated from the discharge hole 142 without waiting for the valve unit 210 to be completely lowered.

It should be understood that in this embodiment, as in the previous embodiment, the waste developer in the waste tank may be recovered by an empty cartridge. A detailed description thereof is omitted.

FIGS. 14 through 18 are flow charts illustrating a liquid developer refilling method of a liquid electrophotographic printer according to a preferred embodiment of the present invention. The liquid developer refilling method is employed in the liquid developer refilling system described with reference to FIGS. 1 through 13.

Figure 14:
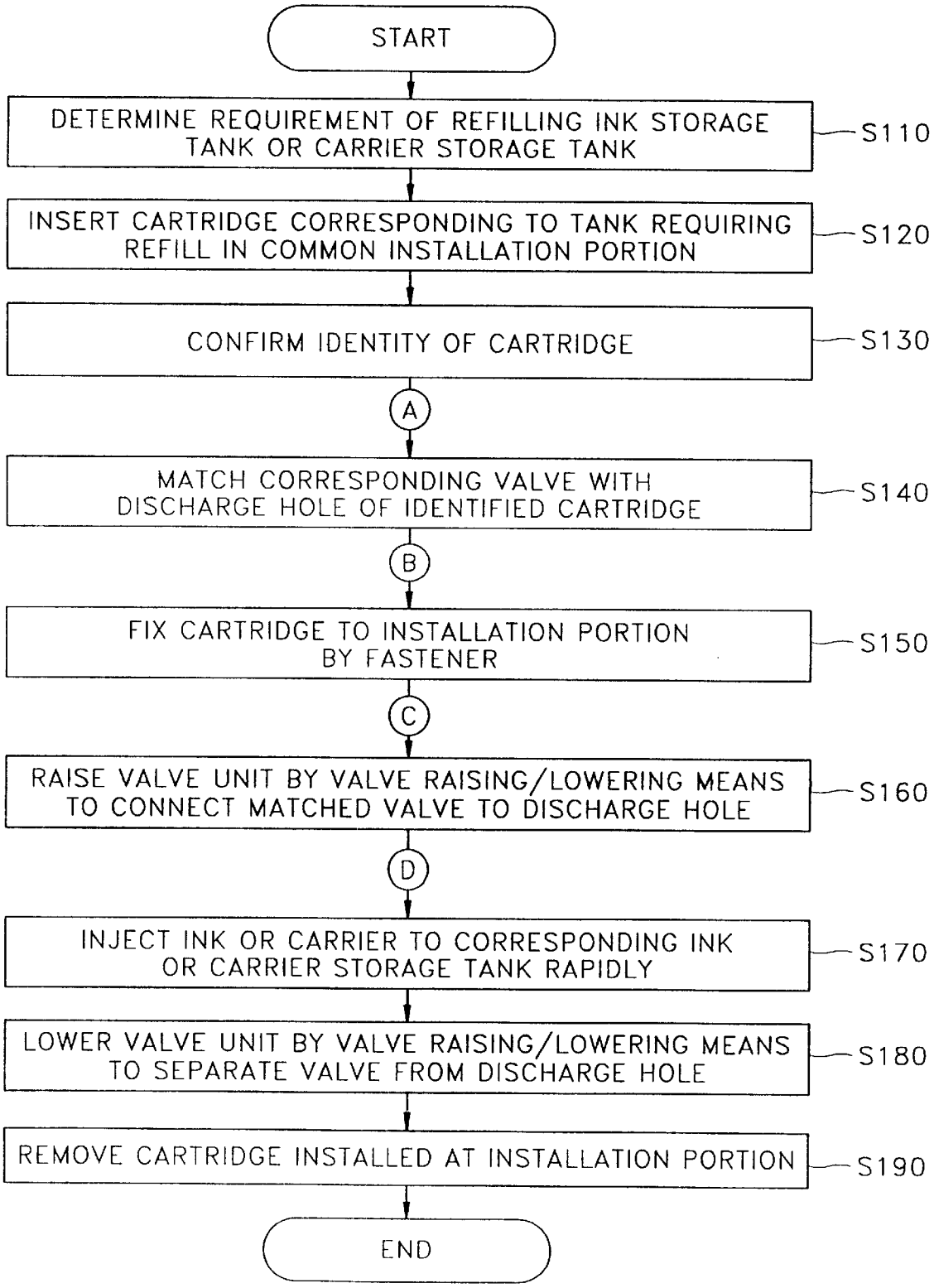
FIG. 14 is a flow chart illustrating a liquid developers refilling method of a liquid electrophotographic printer according to a preferred embodiment of the present invention.
Figure 15:
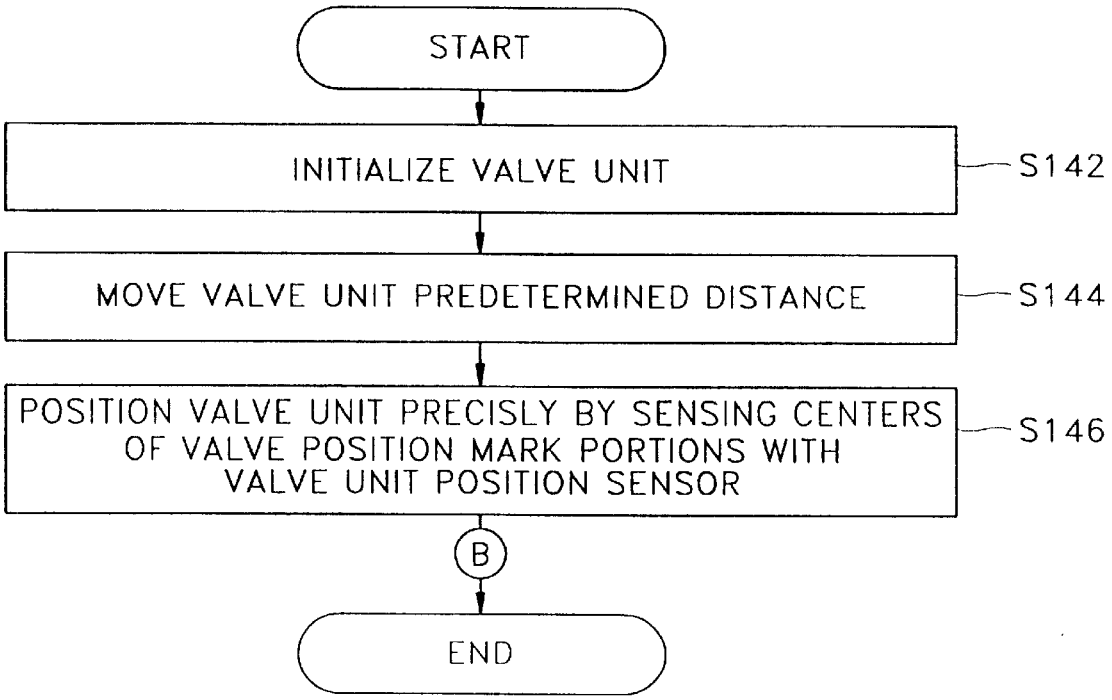
FIG. 15 is a flow chart illustrating in detail the valve unit matching step of the steps shown in FIG. 14.

As shown in FIGS. 1 and 14, first, when any one of concentrated inks or a carrier stored in the respective ink storage tanks 20 or a carrier storage tank is completely consumed in a print mode, it is determined whether refilling any one of the concentrated inks and the carrier is required (step S110). Such determination is performed by level sensors (not shown) installed at the storage tanks 20 and 30. When information of a liquid level of any one of the storage tanks 20 and 30 is "low" or "empty", a system controlling portion generates a message "cartridge requiring flag".

Next, in step S120, a user inserts a cartridge 140 corresponding to the storage tank requiring refilling into a common installation portion 112 via a cartridge guide 119.

Subsequently, in step S130, the identity of the cartridge 140 is confirmed. That is, whether the inserted cartridge 140 is an ink refill cartridge or a carrier refill cartridge is determined, and if the cartridge 140 is an ink refill cartridge, whether the color of the ink is yellow, magenta, cyan, or black is determined. To this end, the system controlling portion operates the three sensors 116 installed at a sensor block 118. The sensors 116 sense whether the lustrous lines 145 marked on the lustrous line mark portions 144 formed on the lusterless surface of the cartridge 140 exist, or the positions thereof, and according to the sensed information, the system controlling portion determines whether the cartridge 140 corresponds to the storage tank requiring a refill. Since the detailed determination method is described above, a description thereof is omitted. When a cartridge which does not correspond to the storage tank requiring a refill or is different from the specifications of the cartridge used in the present invention is installed, the system controlling portion generates a message such as "Insert another cartridge" or "Not a defined cartridge". When a corresponding cartridge is inserted, the sequence proceeds as follows.

That is, in step S140, any one of a plurality of valves 132 installed at a valve unit 130 is matched with a discharge hole 142 of the identified cartridge 140. This step will be described in detail with reference to FIG. 15.

First, the valve unit 130 or a valve unit 210 is initialized in step S142. Here, the valve unit 130 or 210 may be a slider 134 or a disc 212. The initialization of the valve unit 130 or 210 is intended to prevent the cartridge 140 from not being matched with a corresponding valve when a motor, for example, a step motor for driving the slider 134 or disc 212 is rotated a predetermined number of degrees in the next step with the slider 134 or disc 212 is not disposed at the initial position. Such initialization is decided by a first mark portion of slider mark portions 135 or a blade 244.

Subsequently, in step S144, the valve unit 130 or 210 is moved a predetermined distance. That is, the slider 134 is linearly moved or the disc 212 is rotated from the initial position so that the valve communicating with the storage tank requiring a refill can be aligned with the vertical center line of the cartridge 140. Here, the predetermined number of degrees is set to be different from each other according to the positions of the plurality of valves 132 or 226, and the slider position sensor 136 senses the exact positions of the valves 132 by means of the mark portions 135.

Subsequently, in step S146, it is preferable that the valve unit 130 or 210 is precisely positioned by sensing the exact centers of the valve position mark portions such as the slider mark portions 135 or the blade 244 with the valve unit position sensor 136 or 246. Such positioning allows the corresponding valve to be precisely matched with the discharge hole.

Next, in step S150, the cartridge 140 is installed in the installation portion 112 and fixed by a fastener 150 or 260. Here, the fastener 150 or 260 may be composed of a pair of lockers being movable back and forth and an engagement portion 152, or comprised of an engagement portion 262 and a cap 260 provided with a screw portion.

Figure 16:
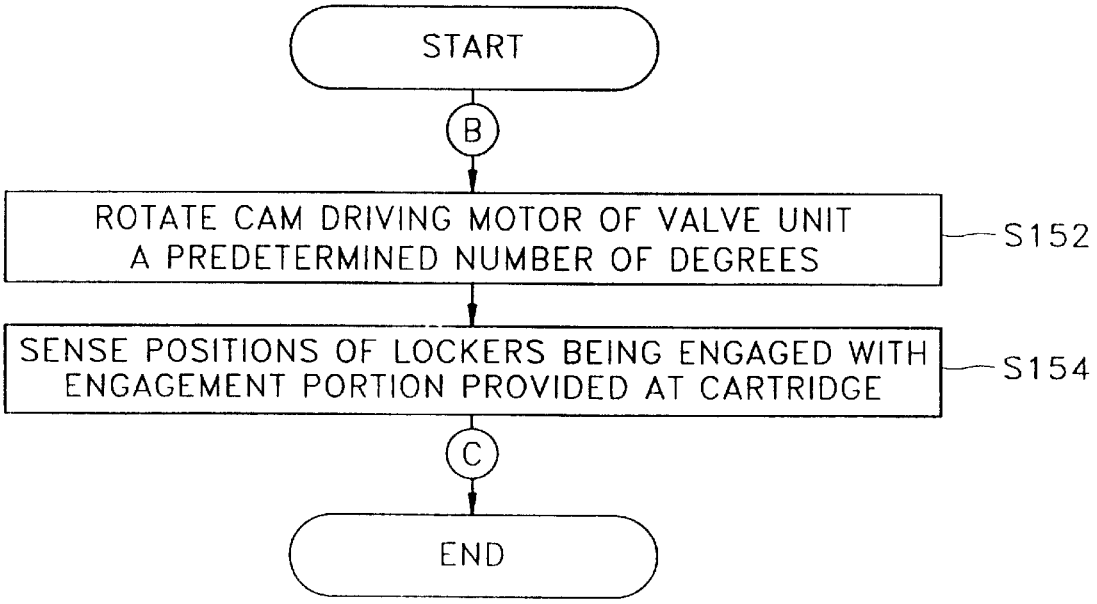
FIGS. 16 and 17 are flow charts illustrating in detail the steps of installing a cartridge in an installation portion, of the steps shown in FIG. 14.

As shown in FIG. 16, in the case of the locker type fastener 150, in step S152, a cam driving motor 176 of the valve unit 130 is rotated clockwise a predetermined number of degrees (please refer to the previously described refilling system about the detailed operation thereof).

Next, in step S154, the position of the lockers 156 which are engaged with the engagement portion 152 is sensed. This sensing is intended to maximize the fixing force against the cartridge 140 by stopping the lockers 156 when the lockers 156 being inserted into a cam groove 161 are moved toward the cartridge 140 to a maximum. That is, after the engagement of the lockers 156 with the engagement portion 152 is confirmed by operating a locker cam sensor 169 at the moment when the lockers 156 are going to complete the engagement with the engagement portion 152 of the cap 154, the cartridge 140 can be fixed to a main frame 110 by stopping the cam driving motor 176.

Figure 17:
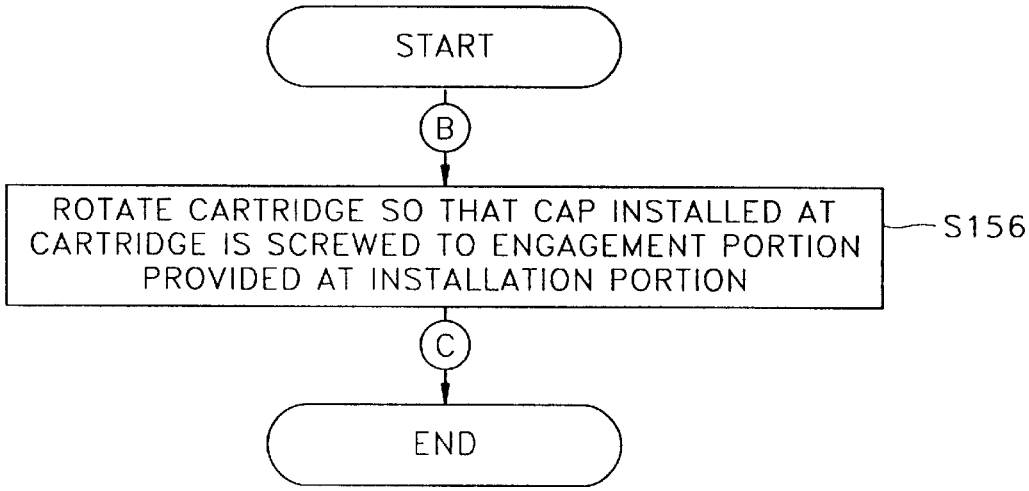
Figure 18:
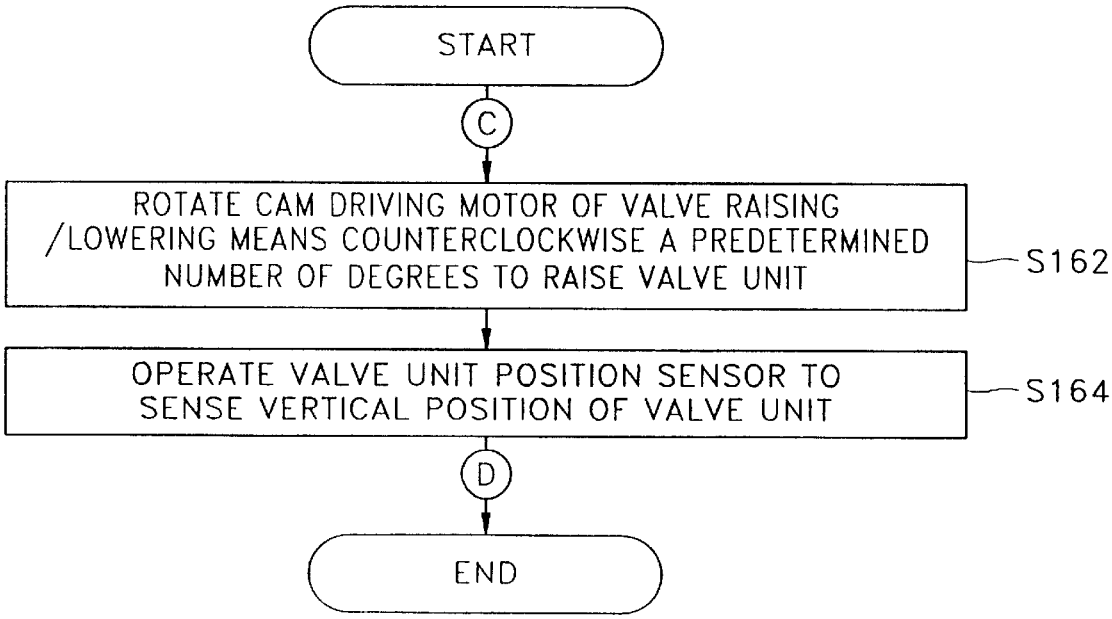
FIG. 18 is a flow chart illustrating in detail the step of raising the valve unit by a valve raising/lowering means so that a matched valve can be connected to a discharge hole, of the steps shown in FIG. 14.

As shown in FIG. 17, in the case of the screw type fastener 260, in step S156, the cartridge is rotated so that the cap installed at the cartridge can be screwed to the engagement portion of the installation portion.

Here, the step S140 and the step S150 are not necessarily performed in a time series, i.e., sequentially. That is, after the step of installing a cartridge and fixing the cartridge by the fastener, a corresponding valve may be matched with the discharge hole of the cartridge.

In step S160, the valve unit 130 or 210 is raised by a valve raising/lowering means so as to connect the matched valve to the discharge hole 142. This operation will be described in detail with reference to FIG. 18.

First, in step S162, the cam driving motor 176 of the valve raising/lowering means is rotated counterclockwise a predetermined number of degrees so as to raise the valve unit 130 or 210 (please refer to the previously described refilling system about the detailed operation thereof).

Subsequently, in step S164, the valve unit position sensor is operated so as to sense the vertical position of the valve unit 130 or 210. This is intended to prevent the valve connected with the discharge hole 142 from being separated from the discharge hole 142 due to further rotation of the cam driving motor 176 by stopping the valve unit at the highest position.

Next, in step S170, the ink or carrier is rapidly injected into the corresponding ink storage tank or the carrier storage tank. Such rapid injection can be performed by compressed gas in the cartridge 140. The cartridge 140 has no hole other than the discharge hole 142. However, since the compressed gas can cause the ink or carrier in the cartridge 140 to be rapidly supplied to the corresponding tank via the discharge hole 142, the problem of long injection time can be solved.

Subsequently, in step S180, the valve unit is lowered by the valve raising/lowering means so that the valve can be separated from the discharge hole 142. This operation can be performed by simply repeating the step S160. Here, it should be noted that when the valve unit 130 or 210 reaches the lowest position, the cam driving motor 176 must be stopped.

Finally, in step S190, the cartridge installed at the installation portion 112 is separated from the installation portion 112. This can be performed by the withdrawal of the lockers or the counterclockwise rotation of the cartridge, as described in the step S150. Returning the slider 134 moved by the predetermined distance back to the initial position allows the following operation to be smoothly performed.

Figure 19:
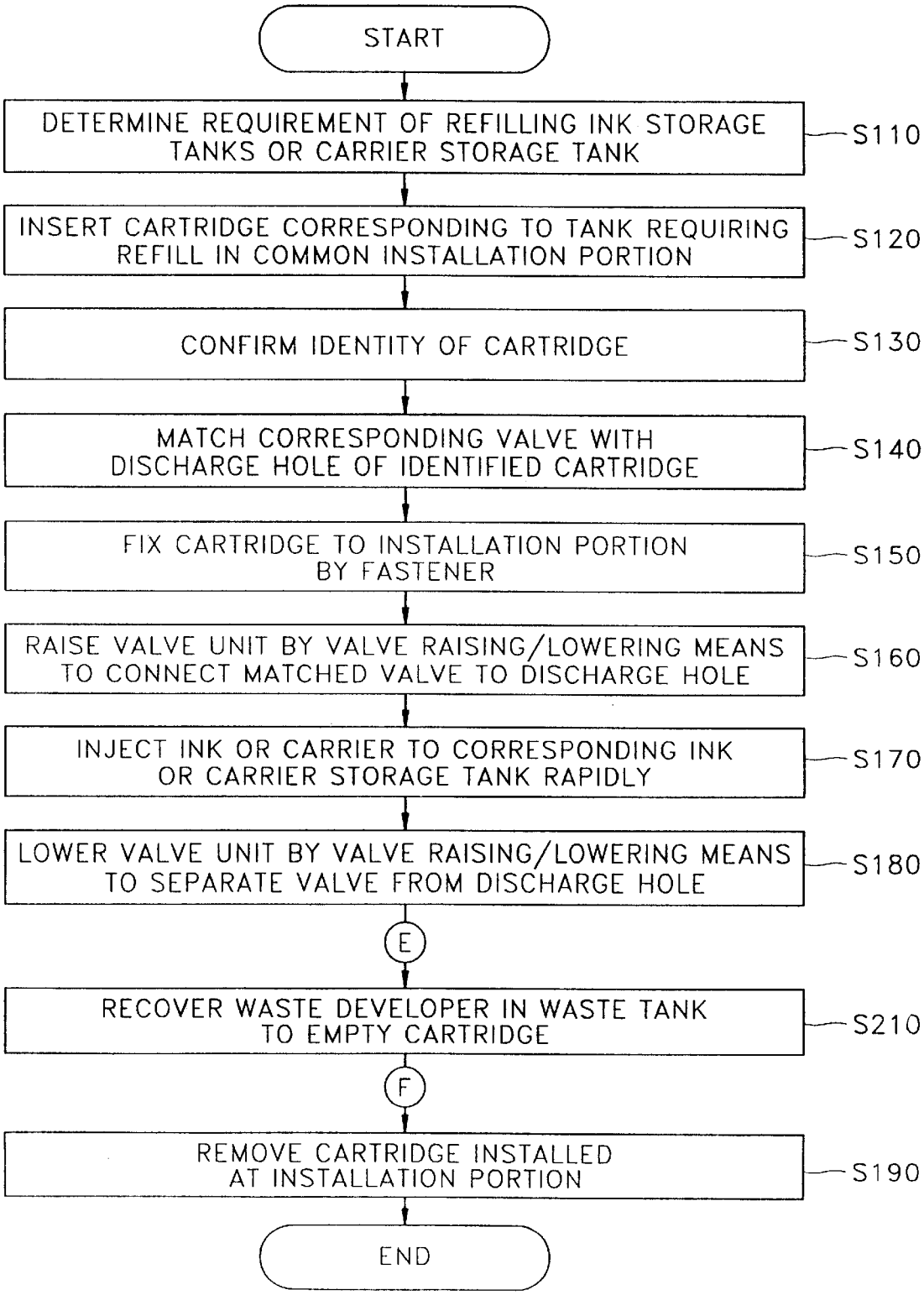
FIG. 19 is a flow chart illustrating a liquid developer refilling method of a liquid electrophotographic printer according to another embodiment of the present invention.

FIG. 19 is a flow chart illustrating a liquid developer refilling method of a liquid electrophotographic printer according to another embodiment of the present invention. Since the same reference numerals as those shown in FIG. 14 denote the same step as the previous embodiment, detailed description thereof is omitted.

In this embodiment, a cartridge is not separated from the installation portion after the refilling operation with the cartridge is completed, and waste developer within the waste tank is supplied to the empty cartridge fixed to the installation portion, and therefore less effort can be exerted in installing a separate empty cartridge for recovering the waste developer. It is preferable that such waste developer recovering operation is performed after a liquid developer is refilled when the waste tank is full.

Figure 20:
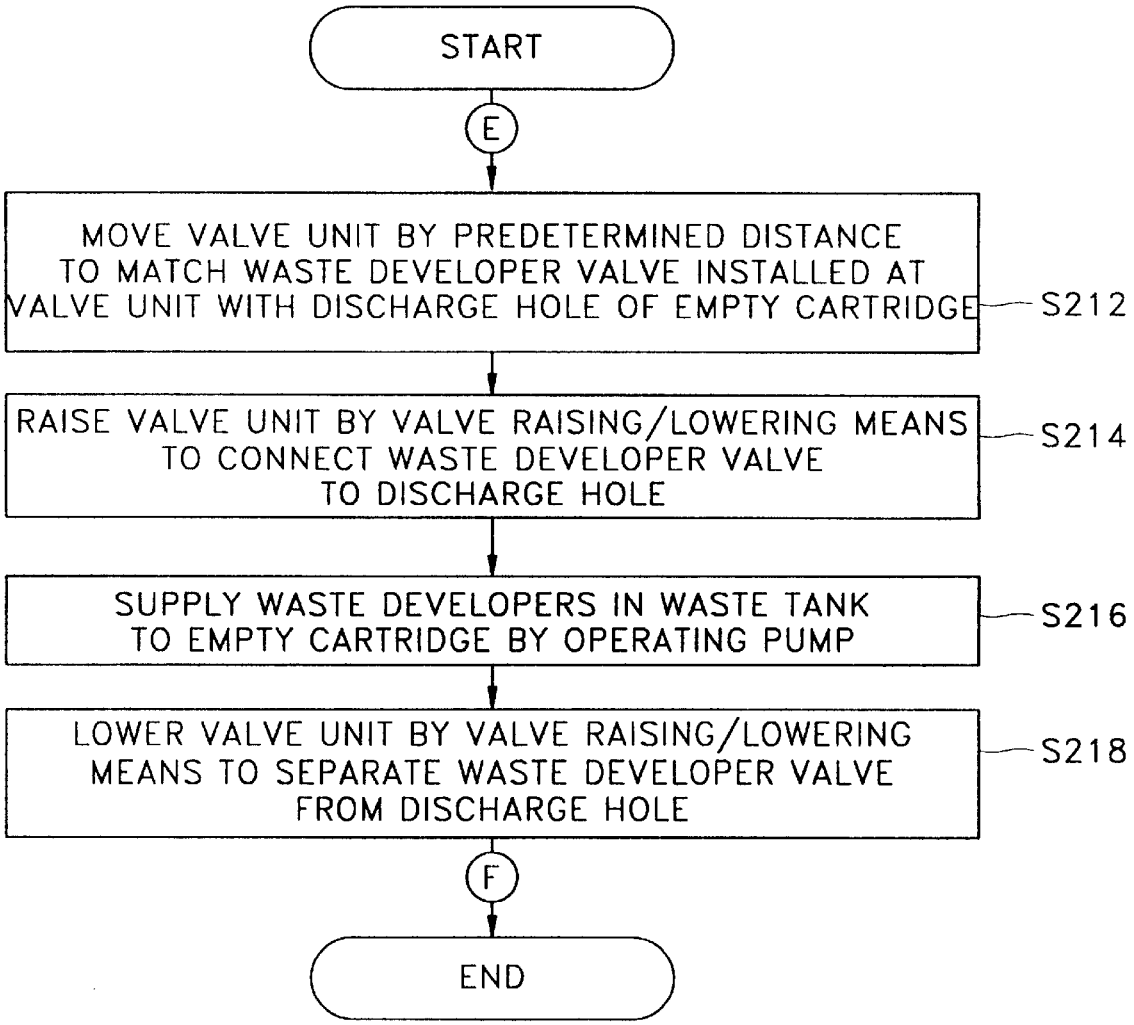
FIG. 20 is a diagram illustrating in detail the step of recovering waste developer in a waste tank to an empty refill cartridge, of the steps shown in FIG. 19.

Referring to FIGS. 1 through 13 and FIG. 19, step S210 is performed with the valve unit lowered after a liquid developer is refilled. That is, waste developer within the waste tank 70 is recovered to an empty cartridge 140. This is preferable when the waste tank 70 is full of waste developer and there is a need to recover the waste developer to the outside as described above. This operation will be described in detail with reference to FIG. 20.

First, in step S212, the valve unit 130 or 210 is moved a predetermined distance so that a waste developer valve 132*c* installed at the valve unit 130 or 210 can be matched with the discharge hole 142 of the empty cartridge 140. The principle of this operation is the same as that described in step S144, and different only in the moving distance. Here, the valve unit 130 or 210 may be moved by a predetermined distance as to the position of the waste developer valve 132*c* after the valve unit is moved to the initial position. However, when the positions of the valves are determined in advance, the same effect can be acquired by moving the valve unit 130 or 210 a required distance determined by the relative positions between the valves even though the valve unit 130 or 210 is not moved to the initial position.

Next, in step S214, the valve unit 130 or 210 is raised to the highest position by the valve raising/lowering means so that the waste developer valve 132*c* can be connected to the discharge hole 142. This operation is the same as in the step S160.

Subsequently, in step S216, the waste developer within the waste tank 70 is supplied to the empty cartridge 140 by operating a waste pump (not shown) installed on a waste developer passage (not shown). In this case, the discharge hole 142 of the cartridge 140 serves as a waste developer inflow hole.

After the waste developer is sufficiently discharged, finally in step S218, the valve unit 130 or 210 is lowered by the valve raising/lowering unit so that the waste developer valve 132*c* can be separated from the discharge hole 142.

As described above, the liquid developer refilling system of a liquid electrophotographic printer according to the present invention exhibits the following effects.

First, after the plurality of valves are installed at the disc or slider so that a corresponding valve can be matched with the cartridge installed in the common installation portion, and the corresponding valve is matched with the discharge hole by the rotation of the disc or the horizontal movement of the slider, the valve can be selectively matched with the discharge hole by raising the valve unit by the cam means.

Second, since the cartridge of the same specifications is used at the common installation portion for refilling the concentrated inks and the carrier, the efficiency of the system can be heightened.

Third, when a waste valve is added to the plurality of valves and an empty cartridge is used for recovering waste developer, the liquid developer refilling system can be used as a waste developer recovering system.

Fourth, since the plurality of valves can be arranged to be compact in the case of the disc or slider type valve matching system, the present invention can contribute to making the apparatus compact.

Fifth, since lustrous line portions are provided at a predetermined position of the cartridge surface treated to be lusterless, and a plurality of sensors are installed for confirming the identity of the cartridge according to whether the lustrous lines positioned on the lustrous line portions exist or not and the positions thereof, the cartridge can be easily recognized.

Sixth, since one of the plurality of sensors installed on the sensor block is used as a spare sensor and can be utilized with the other sensors when any one malfunctions, the efficiency of the system can be heightened.

Seventh, since the fastener for fixing a cartridge to the main frame is configured to fasten the cartridge in a manually screwing manner or in an automatically-operated-locker manner, the cartridge can be stably installed at the main frame.

Eighth, in the case of the locker type fastener, since the motor used in the cam driving means can also be used as a motor for driving the locker moving portion, the cost of the system can be reduced.

What is claimed is:

1. A liquid developer refilling system of a liquid electrophotographic printer, for refilling any one of concentrated inks and a carrier to a corresponding ink storage tank and a carrier storage tank installed in the printer, comprising:

a main frame provided with a common installation portion;

an auxiliary frame installed to be movable with respect to the main frame;

a cartridge installed at the common installation portion and provided with a discharge hole through which a concentrated ink or carrier is discharged by compressed air;

a fastener for fixing the cartridge installed at the common installation portion to the main frame;

a valve unit provided with a plurality of valves which are operative to be selectively matched with the discharge hole and installed to be movable with respect to the auxiliary frame; and a valve raising/lowering mechanism which raises or lowers the auxiliary frame with respect to the main frame to connect or disconnect a corresponding valve to or from the discharge hole.

2. The liquid developer refilling system of a liquid electrophotographic printer as claimed in claim 1, wherein the valve unit comprises:

a disc provided with the plurality of valves which are installed at predetermined positions and are operative to be selectively matched with the discharge hole, and being rotatable with respect to the auxiliary frame;

disc supporter portions installed at the auxiliary frame to support the disc; and a disc rotating portion installed at the auxiliary frame to rotate the disc.

3. The liquid developer refilling system of a liquid electrophotographic printer as claimed in claim 2, wherein each of the disc supporter portions comprises:

a disc supporting bracket installed at the auxiliary frame;

a roller contacting portion formed at the disc; and a roller installed at the disc supporting bracket so as to contact the roller contacting portion and to be rotatable.

4. The liquid developer refilling system of a liquid electrophotographic printer as claimed in claim 2 or 3, wherein the disc rotating portion comprises:

a disc driving gear installed at the auxiliary frame so as to mesh with a disc gear formed on the circumferential surface of the disc and to be rotatable; and a disc driving motor installed at the auxiliary frame so as to rotate the disc driving gear.

5. The liquid developer refilling system of a liquid electrophotographic printer as claimed in claim 2, wherein the valve unit further comprises a disc position sensing portion for sensing an initial position of the disc.

6. The liquid developer refilling system of a liquid electrophotographic printer as claimed in claim 5, wherein the disc position sensing portion includes:

a blade installed at the disc; and a disc position sensor installed at the auxiliary frame to be positioned on the rotational radius of the blade.

7. The liquid developer refilling system of a liquid electrophotographic printer as claimed in claim 1, wherein the valve unit comprises:

a slider provided with the plurality of valves which are installed at predetermined positions and are operative to be selectively matched with the discharge hole, and being horizontally movable with respect to the auxiliary frame; and a slider moving mechanism which moves the slider horizontally with respect to the auxiliary frame.

8. The liquid developer refilling system of a liquid electrophotographic printer as claimed in claim 7, wherein the slider moving mechanism further comprises:

a pair of guide rods installed at the auxiliary frame;

a slider rack portion installed at the slider so as to be assembled to the pair of guide rods;

a slider pinion installed at the auxiliary frame so as to mesh with the slider rack portion formed in a lengthwise direction of the slider and to be rotatable; and a slider driving motor installed at a slider bracket installed at the auxiliary frame for driving the slider pinion.

9. The liquid developer refilling system of a liquid electrophotographic printer as claimed in claim 7 or 8, wherein the valve unit further comprises a slider position sensing device which senses the position of the slider so as to selectively match one of the valves to the discharge hole.

10. The liquid developer refilling system of a liquid electrophotographic printer as claimed in claim 9, wherein the slider position sensing device includes:

a plurality of valve position mark portions formed at the positions corresponding to the positions of the plurality of valves in the lengthwise direction of the slider; and a slider sensor installed at the auxiliary frame so as to sense the positions of the valve position mark portions.

11. The liquid developer refilling system of a liquid electrophotographic printer as claimed in claim 1, wherein the valve raising/lowering mechanism comprises:

supporter portions formed at the auxiliary frame to be projected therefrom;

a cam shaft rotatably installed at the main frame;

cam members installed on the cam shaft to contact the supporter portions; and a cam driving portion installed at the main frame so as to transfer a rotational force to the cam shaft.

12. The liquid developer refilling system of a liquid electrophotographic printer as claimed in claim 11, wherein the cam driving portion comprises:

a cam driving motor installed at the main frame;

a train of gears installed at the main frame for transferring the rotational force of the cam driving motor to the cam shaft.

13. The liquid developer refilling system of a liquid electrophotographic printer as claimed in claim 11 or 12, wherein the valve unit further comprises a valve unit position sensing portion for sensing a vertical position of the valve unit with respect to the main frame so as to sense whether the corresponding valve is connected to the discharge hole.

14. The liquid developer refilling system of a liquid electrophotographic printer as claimed in claim 13, wherein the valve unit position sensing portion comprises:

a mark member installed on the cam shaft; and a valve unit position sensor installed at the main frame so as to sense the position of the valve unit according to the rotation of the mark member.

15. The liquid developer refilling system of a liquid electrophotogaphic printer as claimed in claim 1, wherein the fastener comprises:

a cap installed at the cartridge so as to surround the discharge hole; and an engagement portion formed at an inside of the installation portion for the cap to be assembled.

16. The liquid developer refilling system of a liquid electrophotographic printer as claimed in claim 1, wherein the fastener comprises:

a cap at which an engagement portion is formed and which is installed at the cartridge so as to surround the discharge hole;

lockers installed at the main frame and operative to be movable so as to be engaged with the engagement portion; and locker moving portions for moving the lockers with respect to the main frame.

17. The liquid developer refilling system of a liquid electrophotographic printer as claimed in claim 16, wherein each of the locker moving portions comprises:

a locker cam at which a cam groove of a predetermined shape and a locker cam gear are formed and which is rotatably installed at the main frame;

a cam pole installed at the locker so as to be inserted into the cam groove through an elongated locker hole;

a worm gear installed at the main frame so as to mesh with the locker cam gear and to be rotatable; and a worm driving motor for driving the worm gear.

18. The liquid developer refilling system of a liquid electrophotographic printer as claimed in claim 17, wherein each of the locker moving portions further comprises a locker position sensor which senses whether the lockers are assembled to or disassembled from the cap according to the position of the lockers.

19. The liquid developer refilling system of a liquid electrophotographic printer as claimed in claim 18, wherein the locker position sensor includes:

a semicircular projection member installed at the locker cam to be projected therefrom; and a locker cam sensor installed at the main frame to respond to the position of the projection member.

20. The liquid developer refilling system of a liquid electrophotographic printer as claimed in claim 1, wherein a cartridge guide installed at the main frame is further comprised for guiding the cartridge being inserted into the installation portion.

21. The liquid developer refilling system of a liquid electrophotographic printer as claimed in claim 1, wherein the plurality of valves include at least two valves, which are comprised of a concentrated ink valve for refilling a concentrated ink stored in the cartridge; and a carrier valve for refilling the carrier stored in the cartridge to the printer.

22. The liquid developer refilling system of a liquid electrophotographic printer as claimed in claim 1, wherein the system further comprises a cartridge recognizing device which senses whether a concentrated ink or carrier is stored in the cartridge installed at the installation portion, and for sensing the color of the ink when a concentrated ink is stored in the cartridge.

23. The liquid developer refilling system of a liquid electrophotographic printer as claimed in claim 22, wherein the cartridge recognizing device comprises:

at lease three lustrous line mark portions formed at the surface of the cartridge treated to be lusterless; and a plurality of sensors installed at positions on the main frame corresponding to the lustrous line mark portions, and the identity of the cartridge is determined according to the combinations of whether lustrous lines marked on the lustrous line mark portions exist and the positions thereof, and senses the color of the concentrated ink stored in the cartridge.

24. The liquid developer refilling system of a liquid electrophotographic printer as claimed in claim 23, wherein the cartridge recognizing device further coomprises:

a spare lustrous line mark portion formed on the lusterless surface of the cartridge; and a spare sensor installed at a position on the main frame corresponding to the spare lustrous line mark portion, and when any one of the plurality of sensors malfunctions, the identity of the cartridge can be determined by the combinations of the other sensors including the spare sensor.

25. The liquid developer refilling system of a liquid electrophotographic printer as claimed in claim 1, wherein a waste developer recovering device which recovers waste developer produced in the printer to an empty cartridge.

26. The liquid developer refilling system of a liquid electrophotographic printer as claimed in claim 25, wherein the empty cartridge is installed at the installation portion, and the valve unit further comprises a waste developer valve connected to a waste developer recovering passage in a waste tank installed in the printer.

27. A liquid developer refilling method of a liquid electrophotographic printer for refilling any one of concentrated inks and a carrier from an ink cartridge or carrier cartridge installed to be replaceable at the printer to a corresponding ink storage tank and a carrier storage tank installed in the printer by using a liquid developer refilling system comprising a main frame provided with a common installation portion; an auxiliary frame installed to be movable with respect to the main frame; a cartridge installed at the installation portion and provided with a discharge hole through which a concentrated ink or carrier is discharged by compressed air; a fastener for fixing the cartridge installed at the installation portion to the main frame; a valve unit provided with a plurality of valves which are operative to be selectively matched with the discharge hole and installed to be movable with respect to the auxiliary frame; and a valve raising/lowering mechanism which raises or lowers the auxiliary frame with respect to the main frame to connect or disconnect a corresponding one of the valves to or from the discharge hole, said method including the steps of:

(a) determining whether a necessity of refilling any one of the concentrated inks and the carrier exists;

(b) inserting a cartridge corresponding to the storage tank requiring a refill into the common installation portion;

(c) confirming the identity of the cartridge inserted in the common installation portion;

(d) matching a corresponding valve of the valves with the discharge hole of the identified cartridge;

(e) fixing the cartridge to the common installation portion with the fastener;

(f) raising the valve unit by the valve raising/lowering mechanism so as to connect the matched valve to the discharge hole;

(g) rapidly injecting the ink or carrier into the corresponding ink storage tank or carrier storage tank;

(h) lowering the valve unit by the valve raising/lowering mechanism so as to disconnect the matched valve from the discharge hole; and (i) removing the cartridge from the installation portion.

28. The liquid developer refilling method of a liquid electrophotographic printer as claimed in claim 27, wherein the step (d) includes the steps of:

initializing the valve unit;

moving the valve unit by a predetermined distance; and precisely positioning the valve unit by sensing centers of valve position mark portions with a valve unit position sensor.

29. The liquid developer refilling method of a liquid electrophotographic printer as claimed in claim 27, wherein the step (e) or (i) includes the steps of:

rotating a cam driving motor of the valve raising/lowering mechanism clockwise a predetermined number of degrees; and sensing the positions of lockers being engaged with an engagement portion provided at the cartridge.

30. The liquid developer refilling method of a liquid electrophotographic printer as claimed in claim 27, wherein the step (e) includes the step of rotating the cartridge so that a cap installed at the cartridge is screwed to an engagement portion formed at the installation portion.

31. The liquid developer refilling method of a liquid electrophotographic printer as claimed in claim 27, wherein the step (i) includes the step of rotating the cartridge clockwise so that a cap of the cartridge engaged with the engagement portion of the installation portion is unscrewed.

32. The liquid developer refilling method of a liquid electrophotographic printer as claimed in claim 27, wherein the step (f) or (h) includes the steps of:

rotating a cam driving motor of the valve raising/lowering mechanism counterclockwise a predetermined number of degrees so as to raise or lower the valve unit; and operating a valve unit position sensor to sense a vertical position of the valve unit.

33. A liquid developer refilling method of a liquid electrophotographic printer for refilling any one of concentrated inks and a carrier from an ink cartridge or carrier cartridge installed to be replaceable at the printer to a corresponding one of ink storage tanks and a carrier storage tank installed in the printer and recovering waste liquid developer in a waste tank to an empty cartridge by using a liquid developer refilling system comprising a main frame provided with a common installation portion; an auxiliary frame installed to be movable with respect to the main frame; a cartridge installed at the installation portion and provided with a discharge hole through which a concentrated ink or carrier is discharged by compressed air; a fastener for fixing the cartridge installed at the installation portion to the main frame; a valve unit provided with a plurality of valves which are operative to be selectively matched with the discharge hole and installed to be movable with respect to the auxiliary frame; a valve raising/lowering mechanism which raises or lowers the auxiliary frame with respect to the main frame to connect or disconnect a corresponding one of the valves to or from the discharge hole; and a waste liquid developer recovering device which recovers waste developer produced in the printer to an empty cartridge, said method including the steps of:

(a) determining whether a necessity of refilling any one of the concentrated inks and the carrier exists;

(b) inserting a cartridge corresponding to the storage tank requiring a refill into the common installation portion;

(c) confirming the identity of the cartridge inserted in the common installation portion;

(d) matching a corresponding valve of the valves with the discharge hole of the identified cartridge;

(e) fixing the cartridge to the common installation portion with the fastener;

(f) raising the valve unit by the valve raising/lowering mechanism so as to connect the matched valve to the discharge hole;

(g) rapidly injecting the ink or carrier into the corresponding ink storage tank or carrier storage tank;

(h) lowering the valve unit by the valve raising/lowering mechanism so as to disconnect the matched valve from the discharge hole;

(i) recovering waste liquid developer in the waste tank to an empty cartridge; and (j) removing the cartridge fixed to the common installation portion by the fastener from the common installation portion.

34. The liquid developer refilling method of a liquid electrophotographic printer as claimed in claim 33, wherein the step (i) comprises the steps of:

moving the valve unit by a predetermined distance so as to match a waste developer valve installed at the valve unit with the discharge hole of the empty cartridge;

raising the valve unit by the valve raising/lowering mechanism so as to connect the waste developer valve to the discharge hole;

supplying the waste developer in the waste tank to the empty cartridge by operating a pump; and lowering the valve unit by the valve raising/lowering mechanism so as to disconnect the waste developer valve from the discharge hole.

* * * * *